US010245609B2

(12) United States Patent
Koland et al.

(10) Patent No.: US 10,245,609 B2
(45) Date of Patent: Apr. 2, 2019

(54) FITMENT AND FITMENT ADAPTER FOR DISPENSING SYSTEMS AND METHODS FOR MANUFACTURING SAME

(71) Applicant: ENTEGRIS, INC., Billerica, MA (US)

(72) Inventors: Amy Koland, Eden Prairie, MN (US); Richard Chism, Round Rock, TX (US); Bruce Musolf, Eagan, MN (US)

(73) Assignee: Entegris, Inc., Billerica, MA (US)

( * ) Notice: Subject to any disclaimer, the term of this patent is extended or adjusted under 35 U.S.C. 154(b) by 61 days.

(21) Appl. No.: 15/038,715

(22) PCT Filed: Nov. 24, 2014

(86) PCT No.: PCT/US2014/067156

§ 371 (c)(1),
(2) Date: May 23, 2016

(87) PCT Pub. No.: WO2015/081021

PCT Pub. Date: Jun. 4, 2015

(65) Prior Publication Data

US 2016/0288149 A1 Oct. 6, 2016

Related U.S. Application Data

(60) Provisional application No. 61/908,858, filed on Nov. 26, 2013.

(51) Int. Cl.
*B05B 15/30* (2018.01)
*B05B 11/00* (2006.01)
(Continued)

(52) U.S. Cl.
CPC ..... *B05B 15/30* (2018.02); *B05B 9/04* (2013.01); *B05B 11/0089* (2013.01); *B05B 11/00412* (2018.08); *B67D 7/0288* (2013.01)

(58) Field of Classification Search
CPC . B05B 15/30; B05B 11/0043; B05B 11/0089; B67D 7/0288
(Continued)

(56) References Cited

U.S. PATENT DOCUMENTS 2,500,169 A * 3/1950 Ellis ..... H01M 2/362 141/329
3,101,102 A * 8/1963 Gearhart ..... B67D 7/54 137/421
(Continued)

FOREIGN PATENT DOCUMENTS

CN 1452588 A 10/2003
CN 101754924 A 6/2010
(Continued)

OTHER PUBLICATIONS

Ware, Donald, U.S. Appl. No. 61/561,493, filed Nov. 18, 2011, pp. 1-35.
(Continued)

*Primary Examiner* — Timothy L Maust
(74) *Attorney, Agent, or Firm* — Entegris, Inc.

(57) ABSTRACT

Improved fitment assemblies for headspace gas removal. In one configuration, a fitment assembly includes a fitment defining a fluid pathway between an interior and an exterior of a container, the fitment including a tubular body having an upper neck portion and a lower neck portion, the lower neck portion depending from the upper neck, the upper neck portion including a proximal end defining a proximal opening. The lower neck portion including a distal end defining a distal opening, the tubular body defining a central bore that passes therethrough, the central bore being concentric about a central axis and passing through the proximal opening and the distal opening a flange for coupling with a container, the flange extending radially outward at a junction with the upper neck portion and the lower neck portion, wherein the
(Continued)

lower neck portion is configured to extend into the interior of the container.

15 Claims, 10 Drawing Sheets

(51) Int. Cl.
*B67D 7/02* (2010.01)
*B05B 9/04* (2006.01)

(58) Field of Classification Search
USPC ..... 141/374, 383–386; 220/582; 137/317, 137/585
See application file for complete search history.

(56) References Cited

U.S. PATENT DOCUMENTS

| | | | | |
|---|---|---|---|---|
| 3,203,665 | A * | 8/1965 | Grant | A61C 13/277 251/284 |
| 3,797,538 | A * | 3/1974 | Mollura | A47C 27/085 141/313 |
| 3,894,659 | A | 7/1975 | Focht | |
| 4,212,335 | A * | 7/1980 | Bova | A47C 27/085 141/382 |
| 5,056,171 | A * | 10/1991 | Larson | A47C 27/085 141/386 |
| 5,067,591 | A * | 11/1991 | Fehlig | F16N 5/02 141/21 |
| 5,127,118 | A * | 7/1992 | Johenning | A47C 27/085 141/285 |
| 5,320,253 | A * | 6/1994 | Robinson | A01M 7/0085 137/854 |
| 5,479,970 | A * | 1/1996 | Trani | B67C 11/02 141/297 |
| 6,186,368 | B1 | 2/2001 | Knickerbocker | |
| 6,202,717 | B1 * | 3/2001 | Markey | B67D 7/0294 141/311 R |
| 7,335,721 | B2 | 2/2008 | Alberg | |
| 7,942,860 | B2 * | 5/2011 | Horppu | A61J 1/2089 141/2 |
| 8,146,625 | B2 * | 4/2012 | Xin | G01F 23/74 141/372 |
| 8,313,821 | B2 | 11/2012 | Yan et al. | |
| 9,079,758 | B2 | 7/2015 | O'Dougherty et al. | |
| 9,126,749 | B2 | 9/2015 | Hodges et al. | |
| 2008/0105713 | A1 | 5/2008 | Fahy et al. | |
| 2009/0057347 | A1 | 3/2009 | Leys et al. | |
| 2009/0212071 | A1 | 8/2009 | Tom et al. | |
| 2009/0297769 | A1 | 12/2009 | Yan et al. | |
| 2010/0112815 | A1 | 5/2010 | O'Dougherty et al. | |
| 2010/0181330 | A1 | 7/2010 | Quasters | |
| 2011/0187028 | A1 | 8/2011 | Menning et al. | |
| 2011/0220652 | A1 | 9/2011 | Corbett et al. | |
| 2011/0226806 | A1 | 9/2011 | O'Dougherty et al. | |

FOREIGN PATENT DOCUMENTS

| | | | |
|---|---|---|---|
| EP | 0 557 913 | A2 | 9/1993 |
| JP | S5691294 | U | 7/1981 |
| JP | H1159726 | A | 3/1999 |
| JP | 2013-545676 | A | 12/2013 |
| KR | 100973707 | | 8/2010 |
| WO | 99/39990 | A1 | 8/1999 |
| WO | 02/00525 | A1 | 1/2002 |
| WO | 2009/076101 | A1 | 6/2009 |
| WO | 2011/006146 | A2 | 1/2011 |
| WO | 2011/046802 | A2 | 4/2011 |
| WO | 2011/071897 | A2 | 6/2011 |
| WO | 2012/051093 | A2 | 4/2012 |
| WO | 2012/051496 | A2 | 4/2012 |
| WO | 2012/071370 | A2 | 5/2012 |
| WO | 2012/071376 | A2 | 5/2012 |
| WO | 2012/078977 | A2 | 6/2012 |
| WO | 2012/118527 | A1 | 9/2012 |
| WO | 2013/074923 | A1 | 5/2013 |

OTHER PUBLICATIONS

Ware, Donald, U.S. Appl. No. 61/525,540, filed Aug. 19, 2011, pp. 1-40.
Dubois, Larry, U.S. Appl. No. 61/468,832, filed Mar. 29, 2011, pp. 1-37.
Tom, Glenn, U.S. Appl. No. 61/605,011, filed Feb. 29, 2012, p. 1-52.
Tom, Glenn, U.S. Appl. No. 61/703,996, filed Sep. 21, 2012, pp. 1-67.
Kusz, Matt, U.S. Appl. No. 61/721,838, filed Nov. 2, 2012, pp. 1-35.

* cited by examiner

FITMENT AND FITMENT ADAPTER FOR DISPENSING SYSTEMS AND METHODS FOR MANUFACTURING SAME

RELATED APPLICATIONS

This application is a National Phase entry of PCT Application No. PCT/US2014/067156, filed Nov. 24, 2014, which claims the benefit of U.S. Provisional Patent Application No. 61/908,858, filed Nov. 26, 2013, the disclosures of which are incorporated by reference herein in their entireties.

FIELD OF THE DISCLOSURE

The present disclosure relates to fitments and fitment adapters for use with dispensing systems and methods for manufacturing the same.

BACKGROUND OF THE DISCLOSURE

Container systems may be used in many industries for storing, shipping and dispensing materials of various viscosities. For example, numerous manufacturing processes require the use of ultrapure liquids, such as acids, solvents, bases, photoresists, slurries, cleaning formulations, dopants, inorganic, organic, metalorganic and biological solutions, pharmaceuticals, and radioactive chemicals. Many other industries use container systems for a variety of applications, for example the food industry, pharmaceutical industry, cosmetic industry. Typically, a shipping and dispensing system includes a container of some kind, a liner, a cap to seal and protect the contents of the storage system when the contents are not being dispensed, and a connector to dispense the contents from the container. The liner and/or container can include a fitment that allows caps, connectors, or other coupling devices to be coupled with the container system. Some systems further include a dip tube or a dip tube assembly that may assist in dispensing the contents of the container.

Conventional fitments may include a neck portion for coupling with a cap, connector, or other coupling device and a flange portion, which may be welded to or integrally formed with the walls of the container. However, in applications where headspace gas removal is desirable, problems can arise when such conventional fitments are utilized. Generally, the expression "headspace" or "headspace gas," as used herein, refers to the gas space in the container that resides above the contents stored in therein, for example, from gas that rises through the liquid to the top of the container. In some cases or for some applications, it is undesirable to leave head space or head space gas in the container, or it may simply be more desirable to have the head space or head space gas removed. For example, if all, or substantially all, of the headspace gas is removed, then generally the only remaining sources of gas bubbles, if any, would be from any folds in the container walls. One issue, for example, is that in order to access and remove the headspace gas, a headspace gas removal connector may be coupled to, fitted with, or adjacently positioned to the neck portion, and a probe of the connector may be inserted through the neck portion down toward and into the container. When doing so, the dip tube assembly may be inadvertently pushed out of the fitment and into the container, where the dip tube may cause damage to the walls of the container. Additionally, the dip tube assembly needs to be reconnected with the fitment for further use, which is both tricky and time consuming, thus heightening the risk of tearing of the container walls.

Conventional dip tube assemblies may include a relatively long and slender tubular portion that may be generally cylindrically shaped having a given diameter and a given length, often depending on the intended use. The tubular portion may be configured for placement so as to extend into an interior cavity of a liner or other container. To assist in proper placement of the tubular portion, the tubular portion may be configured to cooperate with a coupler portion that is shaped and configured to substantially fit into, or adjacent to, the mouth of the liner or other container, such as by fitting into or adjacent to, or coupling with, a fitment portion of the liner or other container, so as to generally fixedly couple or connect the tubular portion with the liner or other container. The tubular portion and coupler portion may be, and often are, separate stand-alone parts. For example, the tubular portion may often be a standard tube and the coupler portion may be a particularly custom part designed to permit coupling between the standard tube and a custom dispense container. In this regard, the coupler portion may often be configured with a tubular receiving cavity designed to receive and accommodate liquid-tight insertion of the tubular portion and an exterior designed to substantially fit into, or adjacent to, the mouth or fitment portion of a particular model container or other custom container.

Some containers, including liners and overpacks, may be relatively large to very large. Large to very large containers may have liner and/or overpack fitments with mouths that are correspondingly relatively large to very large. Accordingly, conventional dip tubes, couplers, and dip tube assemblies may not be appropriately sized for suitable use with some large to very large dispensers. As such, fitment adapters have been used to retrofit the mouth of relatively large liners and overpacks so as to allow known dip tubes, couplers, and dip tube assemblies to be used therewith. However, conventional fitment adapters may not adequately support the dip tube, coupler, or dip tube assembly within the liner, which may result in, for example, relatively slow filling and dispense, and may allow for kinks to form in the dip tube, which may create undesirable bubbles in the contents of the liner, for example. Further, in some cases, if the dip tube coupler is not suitably sized to fit snuggly within the fitment of the liner, the liner may become pinched between the coupler and the fitment, particularly during dispense. Such pinching can result in tears in the liner, which can introduce air or other impurities into the contents of the liner, for example.

Accordingly, there is a need for fitments and fitment adapters that overcome the disadvantages of conventional fitments and fitment adapters in one or more ways. That is, there is a need for improved fitments and fitment adapters and methods for manufacturing the same.

BRIEF SUMMARY OF THE DISCLOSURE

The present disclosure relates to novel and advantageous fitments and fitment adapters for use with container systems, such as but not limited to, liner-based storage and dispensing systems. Generally, as will be provided in greater detail below, a fitment may be welded to or integrally formed with a liner and, in some cases, a fitment adapter may be positioned in and coupled to the fitment of a liner or overpack. A dip tube assembly may be positioned in the fitment adapter, such that the dip tube extends from an interior cavity of the fitment adapter, through an opening in the bottom of the fitment adapter into an interior cavity of the container. A connector, that may be used for dispense for example, may be coupled to the fitment adapter. For example, a probe of a connector may be inserted into an opening in the top of the fitment adapter such that a dispense path is created from which the contents of the liner may be dispensed via the container. Specifically, the contents of the liner may travel from the interior cavity of the container, up the dip tube, through the dip tube coupler, which may be housed in the fitment adapter, through the probe of the connector, and on to the final dispense destination, such as but not limited to, a downstream semiconductor process.

While any fitment, including conventional fitments, may be used with the various embodiments of fitment adapters described in further detail below, embodiments of advantageous fitments, which may be used separately or in combination with the various embodiments of fitment adapters described herein or other fitment adapters, are described with respect to FIGS. 10-12. As described above, in applications where headspace gas removal is desired, conventional fitments can create significant issues. For example, in order to access and remove the headspace gas, a headspace gas removal connector may be coupled to, fitted with, or adjacently positioned to the neck portion, and a probe of the connector may be inserted through the neck portion down toward or into the container. When doing so, the dip tube assembly may be inadvertently pushed out of the fitment and into the container, where the dip tube can cause damage to the walls of the container. Fitment embodiments of the present disclosure improve on the deficiencies of conventional fitments.

Like conventional fitments, the fitments of the present disclosure may be configured to receive a dip tube assembly therein. The present disclosure, in one embodiment, relates to a fitment for a container creating a rigid fluid pathway between the interior and exterior of the container. The fitment may include a tubular body portion having a central bore therethrough and a flange for welding to one or more walls of the container, thereby affixing the container and fitment, the flange dividing the tubular body portion into an upper and lower neck portion. The lower neck portion may be configured to extend into the interior of the container and may include a vent opening extending from an exterior surface of the lower neck portion to an interior surface of the lower neck portion permitting air or fluid flow therethrough.

The present disclosure, in another embodiment, relates to a fitment adapter for use with a dispensing system, the fitment adapter comprising, a cup portion including an interior cavity; and a stem portion coupleable with the cup portion, the stem portion comprising a rim and a post, where the post is positioned in the interior cavity of the cup, and wherein the rim is coupleable with a mouth of a container of the dispensing system. The post is configured to receive a dip tube assembly, whereby a continuous passageway is created to allow a fluid to flow from an interior of the container through the dip tube and through the post of the fitment adapter.

Structurally, various embodiments of the disclosure include a fitment for defining a rigid fluid pathway between an interior and an exterior of a container, the fitment comprising a tubular body having an upper neck portion and a lower neck portion, the lower neck portion depending from the upper neck. The upper neck portion includes a proximal end defining a proximal opening; the lower neck portion includes a distal end defining a distal opening. The tubular body defines a central bore that passes therethrough, the central bore being concentric about a central axis and passing through the proximal opening and the distal opening. The fitment can further include a flange for coupling with a container, the flange extending radially outward at a junction with the upper neck portion and the lower neck portion.

The lower neck portion is configured to extend into the interior of the container, and, in some embodiments, is configured for coupling with a dip tube. In one embodiment, the lower neck portion includes an interior surface configured for coupling with a dip tube. The lower neck portion can also include structure defining a vent opening that passes radially through the lower neck portion for permitting fluid flow therethrough. In one embodiment, the vent opening is proximate the flange.

The fitment can further comprise a circumferential rib that protrudes radially outward from the upper neck portion. In one embodiment, the circumferential rib is disposed at the proximal end of the upper neck portion.

In various embodiments of the disclosure, a fitment and dip tube subassembly is disclosed, comprising a dip tube operatively coupled to the lower neck portion of the fitment, with the vent opening located between the dip tube and the flange. The dip tube can be operatively coupled to an inside surface of the lower neck portion.

In some embodiments of the disclosure, a method for removing head space gas from a liner-based dispenser is presented, comprising: providing a liner having a fitment coupled thereto, the liner containing a liquid and a headspace gas, the headspace gas being in contact with the fitment, the fitment including a tubular body portion and a flange extending radially outward from the tubular body portion, the tubular body portion defining a central passageway and including a lower neck portion that extends below the flange portion into the headspace gas contained in the liner, the lower neck portion including structure defining a vent opening that is in fluid communication with the central passageway; and drawing the headspace gas through the vent opening and into the central passageway. The method can further comprise coupling a headspace gas removal connector to the fitment, wherein the step of drawing the headspace gas through the vent opening and into the central passageway is performed with the headspace gas removal connector.

In various embodiments, a method for removing head space gas from a liner-based dispenser is disclosed, comprising: providing a liner having a fitment coupled thereto, the liner containing a liquid and a headspace gas, the headspace gas being in contact with the fitment, the fitment including a tubular body portion and a flange extending radially outward from the tubular body portion, the tubular body portion defining a central passageway and including a lower neck portion that extends below the flange portion into the headspace gas contained in the liner, the lower neck portion including structure defining a vent opening that is in fluid communication with the central passageway; and providing instructions on a tangible medium, the instructions comprising drawing the headspace gas through the vent opening and into the central passageway. The instructions can further comprise coupling a headspace gas removal connector to the fitment, wherein the step of drawing the headspace gas through the vent opening and into the central passageway is performed with the headspace gas removal connector.

While multiple embodiments are disclosed, still other embodiments of the present disclosure will become apparent to those skilled in the art from the following detailed description, which shows and describes illustrative embodiments of the disclosure. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

DETAILED DESCRIPTION

Figure 1:
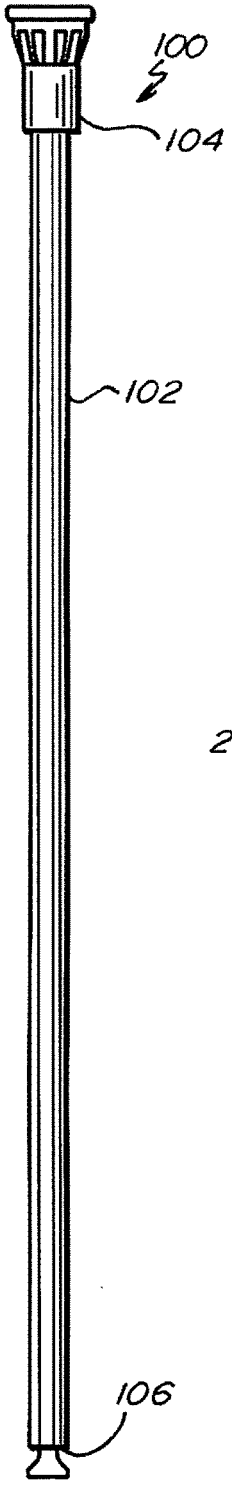
FIG. 1 is a front view of one embodiment of a dip tube assembly that may be used with embodiments of the present disclosure.

Referring to FIG. 1, a dip tube assembly 100 is depicted in an embodiment of the disclosure. The dip tube assembly 100 can include a tubular portion 102 and a coupler portion 104. Tubular portion 102 may be generally cylindrically shaped or straw-like with an interior passageway extending generally from one end to the other, as will be understood by those skilled in the art. The tubular portion 102 may be substantially long and slender; however, it is understood that the tubular portion 102 may have any suitable or desirable length and any suitable or desirable exterior diameter as well as interior passageway diameter. Often the length and diameter of the tubular portion may depend on the intended application and desired dispense characteristics. In some embodiments, a bottom end, or an end opposite the location of the coupler portion 104, may include one or more side wall openings 106. Side wall openings may provide improved dispensing of liquid or other material through the dip tube via the tubular portion 102.

The coupler portion 104 may be coupled with or integral with the tubular portion 102. The coupler portion 104 may take on various configurations, but is generally configured at one end to cooperate in fluid communication with a top end of the tubular portion 102 and at the other end to substantially fit into, or adjacent to, the mouth of a particular liner or other container, such as by fitting into or adjacent to, or otherwise coupling with, a fitment of the liner or other container and/or with a fitment adapter, such as those described in further detail below. The coupler portion 104 may generally assist in the proper placement of the tubular portion 102 and generally maintains the tubular portion in fixed relationship with the liner or container during dispense of the contents therein. The coupler portion 104 also includes an interior passageway extending generally from one end to the other, and the interior passageway is in fluid communication with the interior passageway of the tubular portion, such that a fluid or other material may flow from a bottom end of the tubular portion, through the tubular portion and the coupler, so as to exit at a top end of the coupler, often being delivered to a dispense connector and subsequent downstream process, as would be understood by those skilled in the art. Examples of dip tube assemblies that may be used with embodiments of the present disclosure are further described in U.S. Patent Application No. 61/721,838, entitled, "Dip Tube Assemblies and Methods of Manufacturing the Same," filed Nov. 2, 2012, which is hereby incorporated by reference in its entirety herein, except for express definitions contained therein.

Figure 10A:
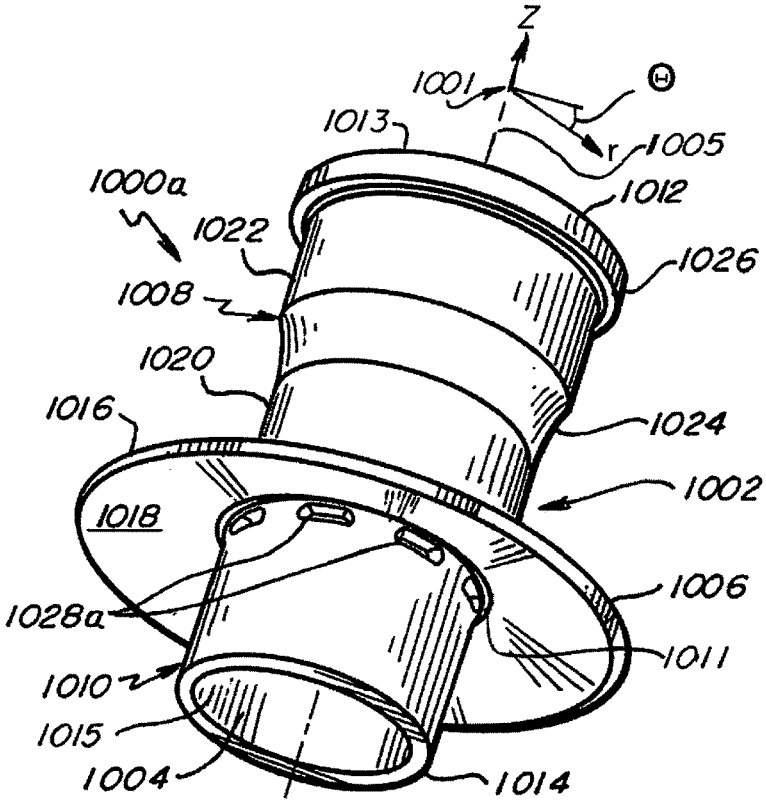
FIG. 10A is a perspective view of a fitment according to one embodiment of the present disclosure.

Referring to FIG. 10A, a fitment 1000*a* is depicted according to one embodiment of the disclosure. The fitment 1000*a* includes a tubular body portion 1002 having a proximal end 1012 defining a proximal opening 1013, and a distal end 1014 defining a distal opening 1015, the tubular body portion 1002 defining a central bore 1004 therethrough that is concentric about a central axis 1005. In one embodiment, the tubular body portion 1002 is divided into an upper neck portion 1008 and a lower neck portion 1010, with the lower neck portion 1010 depending from the upper neck portion 1008. The fitment 1000*a* is herein described in relation to a r-θ-z (right cylindrical) coordinate system 1001, with "radial" referring to a direction along or parallel to the r-coordinate, "circumferential" referring to a direction along or parallel to the θ-coordinate, and "axial" referring to a direction along or parallel to the z-axis.

A flange 1006 extends radially outward (i.e., in a direction away from the central axis 1005) from and circumferentially about the tubular body portion 1002. In one embodiment, the flange 1006 defines a demarcation between an upper neck portion 1008 and lower neck portion 1010 of the tubular body portion 1002. That is, the confluence of the flange 1006, upper neck portion 1008, and lower neck portion 1010 defines a junction 1011, with the flange 1006 extending radially outward from the junction 1011 (best depicted at FIGS. 11A, 11B, and 12). The flange 1006 can be a disk- or plate-shaped structure. In various embodiments, the flange 1006 extends substantially perpendicular to the central axis 1005; in other embodiments, the flange 1006 angles towards one of the proximal end 1012 or distal 1014 end of the tubular body portion 1002. As illustrated in FIG. 10A, the flange 1006 angles slightly toward the distal end 1014 of the tubular body portion 1002. As indicated above, the flange 1006 can be coupled to a container wall, such as the wall of the liner embodiments described below (e.g., liner 1100 of FIG. 11). In various embodiments, the container/liner is coupled to the flange 1006 on an axial-facing surface of the flange 1006. For example, the container/liner wall can be coupled to either a top surface 1016 or a bottom surface 1018 of the flange 1006. In other embodiments, the flange 1006, and thus the fitment 1000*a*, are integrally formed with the walls of the container or liner. Other coupling techniques available to the artisan, such as welding, bonding, or clamping can be utilized for coupling the flange 1006 to the container/liner.

The upper neck portion 1008 can extend any suitable distance above the flange 1006, as may be required or desired for a given application. Additionally, the upper neck portion 1008 can be of a constant diameter, or can define two or more portions 1020 and 1022 having distinct diameters, including any transition portions 1024 between the two or more portions 1020, 1022 (FIG. 10A). Likewise, the upper neck portion 1008 can include one or more circumferential ribs or lips 1026 that protrude radially outward therefrom, or other features (e.g., protrusions, indentations, threading, connections) extending from or being defined by the upper neck portion 1008. The upper neck portion 1008, and the tubular body portion 1002, while illustrated as having a circular cross-section, can define a cross-sectional shape other than circular, such as but not limited to, square, rectangular, polygonal, elliptical, oval, or irregular. The upper neck portion 1008 may be configured for coupling with a cap, connector, or other coupling device, such as but not limited to a headspace gas removal connector or dispense connector.

Unlike conventional fitments, as indicated above, the fitment 1000*a* includes the lower neck portion 1010, configured to extend below the flange 1006 and into the container or liner. As will be described in further detail below, the lower neck portion 1010 assists in overcoming the disadvantages of conventional fitments and in removing headspace gas efficiently and effectively. The lower neck portion 1010 may extend any suitable distance below the flange 1006, as may be required for a given application. Like the upper neck portion 1008, the lower neck portion 1010 can be of substantially constant (as depicted), or can define two or more distinct diameters, as well any transition portions therebetween (not depicted).

In various embodiments, the lower neck portion 1010 can also include one or more circumferential ribs or lips or other protrusions or indentations in the surface thereof (not depicted) as desired or required by an application. The lower neck portion 1010, and the tubular body portion 1002 in general, is illustrated as having a circular cross-section; however, in other embodiments, the lower tubular body portion 1002 cam define a cross-sectional shape other than circular, such as but not limited to, square, rectangular, polygonal, elliptical, oval, or irregular. The upper neck portion 1008 and the lower neck portion 1010 need not extend the same distance away from the flange, have the same cross-sectional shape, or otherwise be mirrored or similar copies of one another. Indeed, the upper and lower neck portions 1008, 1010 will generally not be mirrored images of each other (i.e., will be distinctly identifiable).

The lower neck portion 1010 may further include structure defining one or more vents 1028*a* that pass through the thickness of the lower neck portion to the central bore 1004 of the tubular body portion 1002. The vent(s) 1028*a* can take on various forms, such as slots, holes, circular holes, or other openings. In one embodiment, the vent(s) 1028*a* are located proximate the flange 1006, as depicted in FIG. 10A. In one embodiment, the vent(s) 1028*a* can actually pass through a lower portion of the junction 1011, so that the vent(s) 1028*a* tap into the upper-most apex defined at the confluence of the flange 1006 and the lower neck portion 1010. The vent(s) 1028*a* may be of any suitable size, shape, and dimension. Likewise, the vent(s) 1028*a* may be located in any suitable alternative arrangement along the lower neck, portion 1010 and are limited neither to being defined proximate the flange 1006 nor along a circumferential line, as illustrated in FIG. 10A.

Figure 10B:
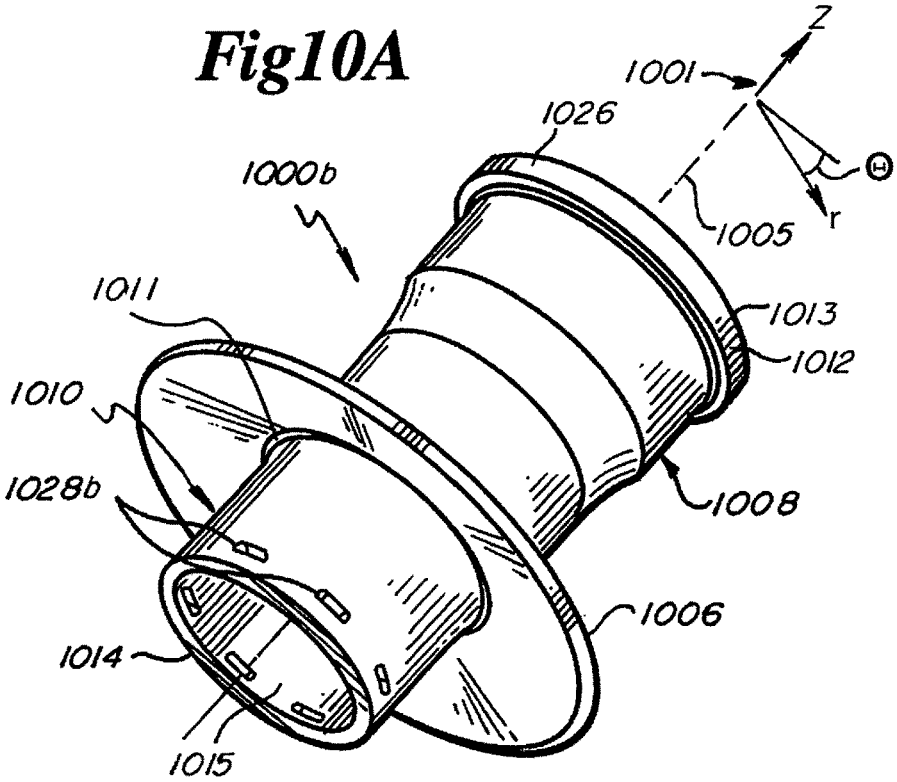
FIG. 10B is a perspective view of a fitment according to another embodiment of the present disclosure.

Referring to FIG. 10B, a fitment 1000*b* is depicted in one such alternative suitable arrangement in an embodiment of the disclosure. For the fitment 1000*b*, vents 1028*b* are located proximate the distal end 1014 of the tubular body portion. The fitment 1000*b* otherwise includes many of the same attributes and components as the fitment 1000*a*, which are indicated with same-numbered numerical references. Hereinafter, fitments 1000*a* and 1000*b* are referred to collectively or generically as fitment or fitments 1000. Likewise, vents 1028*a* and 1028*b* are referred to collectively or generically as vents 1028.

The diameter of the tubular body portion 1002 or any portion thereof, such as the upper or lower neck portions 1008 or 1010, can be suitably configured for the desired application or intended use. For example, in various embodiments, the tubular body portion 1002 or at least one portion thereof may be ¾ of an inch, 1 inch, or 2 inches, to suitably fit conventional caps, connectors, or other standard coupling devices. However, the diameter of the tubular body portion 1002 or any portion thereof is not so limited.

Fitments 1000, including such a vented lower neck portion 1010 can permit effective removal of headspace gas. Such fitments 1000 also allow for a single dip tube assembly design to be used in multiple applications, regardless of whether headspace gas removal is desired or required, and further solves issues related to headspace gas removal using conventional fitments and methods. Particularly, the fitments 1000 of the present disclosure can resolve any issues associated with dip tube assembly push-through, described above, such as the need to reconnect the dip tube assembly and the heightened risk of container or liner wall tearing.

Figure 11A:
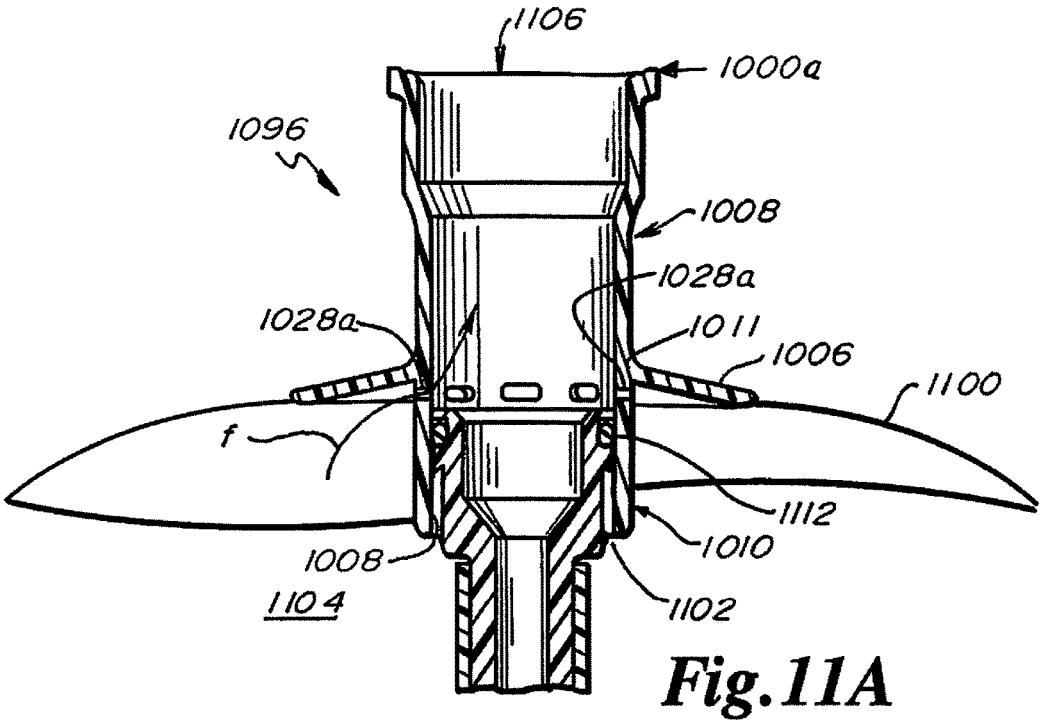
FIGS. 11A and 11B are cross-sectional views of fitment and dip tube subassemblies in application according to embodiments of the present disclosure.

Referring to FIG. 11A, a subassembly 1096 of the fitment 1000*a* and a dip tube assembly 1102 is depicted in an embodiment of the disclosure. The lower neck portion 1010 of the fitment 1000*a* extends downward into the container or liner 1100, thereby providing additional inner surface area 1108 for registration of the dip tube assembly 1102 in an appropriate position. It is noted that a conventional fitment would stop at the flange 1006. The lower neck portion 1010 can thus helps prevent the dip tube assembly 1102 from falling out of coupling with the fitment 1000 and into the container or liner 1100 when a headspace gas removal connector is connected to the fitment 1000*a* and pushes the dip tube assembly 1102 downward past the flange 1006.

As illustrated in FIG. 11A, the dip tube assembly 1102 can be pushed down into the lower neck portion 1010 to a position below the vents 1028*a*. In this regard, an airflow or fluid path, f, is created between the interior 1104 of the container or liner 1100 and the exterior or connector end 1106 of the fitment, thereby permitting effective removal or venting of headspace gas without unseating or otherwise losing control of the dip tube assembly 1102. The dip tube assembly 1102 can be held in position, for example, by a friction fit or a threaded engagement. In the depicted embodiment, a friction fit is provided by an O-ring 1112, which provides for a sealed engagement between the dip tube assembly 1102 and the fitment 1000*a*.

Figure 11B:
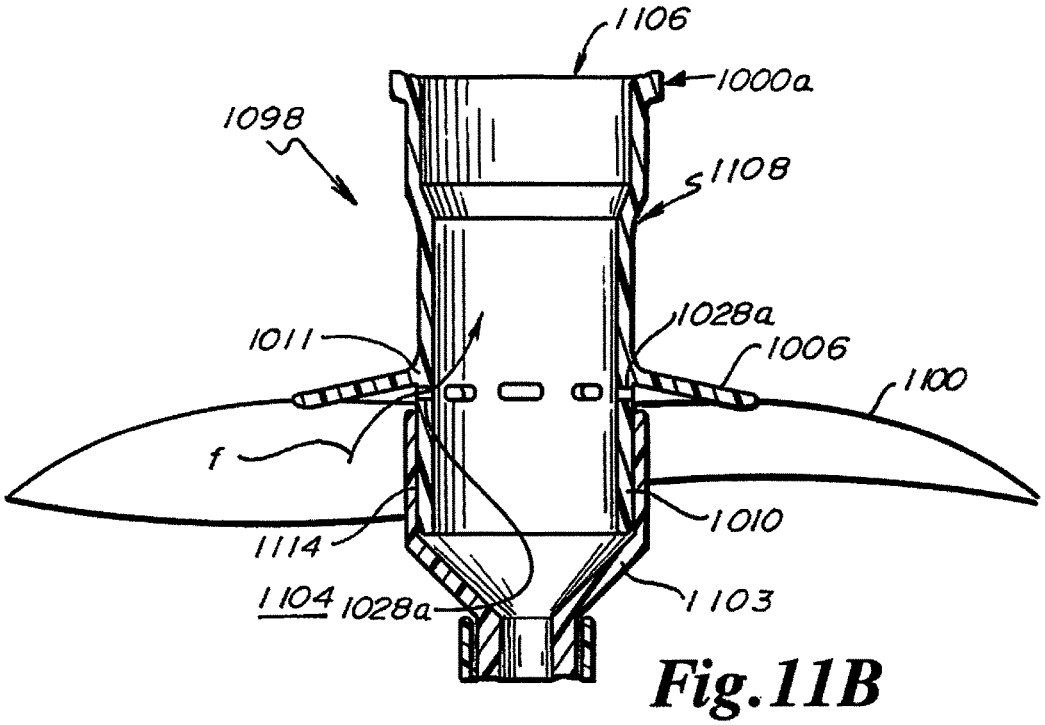

Referring to FIG. 11B, a subassembly 1098 of a fitment 1000*a* and a dip tube assembly 1103 is depicted in an embodiment of the disclosure. The subassembly 1098 includes many of the same components and attributes as the subassembly 1096, which are indicated by same-numbered numerical references. In the 1098 subassembly, the dip tube assembly 1103 is coupled to an outside surface 1114. The dip tube assembly can be held in place to the outside surface 1114, for example, by friction fit (as depicted), threaded engagement, or an O-ring friction fit.

Figure 12:
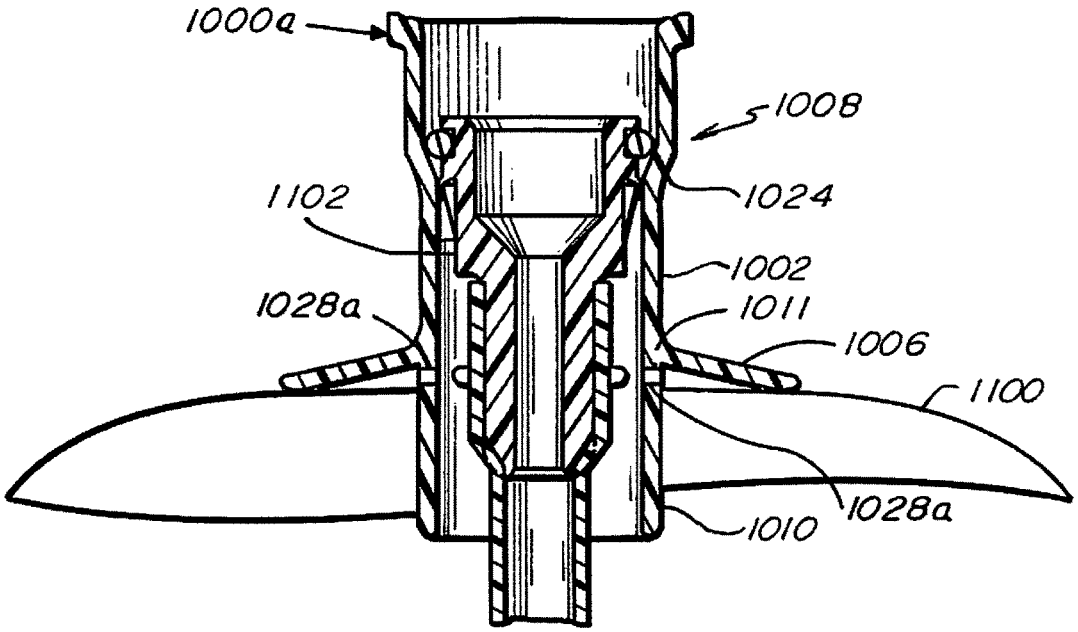
FIG. 12 is a cross-sectional view of a fitment and dip tube assembly in use according to an embodiment of the present disclosure.

Referring to FIG. 12, the fitment 1000*a* is depicted in assembly in an embodiment of the disclosure where head space gas removal is not utilized. The dip tube assembly 1102 can be positioned and remain in a position anywhere along the interior of the tubular body portion 1002. In various embodiments, however, the dip tube assembly 1102 can generally be maintained at a position above the vents 1028 to avoid inadvertent use of the headspace gas venting path, f, enabled by the fitment 1000 of the present disclosure. In one embodiment, as illustrated in FIG. 12, the dip tube assembly 1102 may be positioned generally at a transition portion 1024 of the upper neck portion 1008. In this regard, a fitment 1000 of the present disclosure can provide for effective functionality regardless of whether headspace gas removal is desired. Thus, in applications where headspace gas removal is not important, unnecessary, or undesirable, fitments 1000 can still operate to provide similar functionality to that of a conventional fitment.

The fitments 1000 of the present disclosure can be comprised of any suitable material, or combination of materials, including any suitable plastic, for example, but not limited to one or more polymers, including plastics, nylons, EVOH, polyesters, polyolefins, or other natural or synthetic polymers. In various embodiments, the fitments 1000 are manufactured using polyethylene terephthalate (PET), polyethylene naphthalate (PEN), poly(butylene 2,6-naphthalate) (PBN), polyethylene (PE), linear low-density polyethylene (LLDPE), low-density polyethylene (LDPE), medium-density polyethylene (MDPE), high-density polyethylene (HDPE), polypropylene (PP), and/or a fluoropolymer, such as but not limited to, polychlorotrifluoroethylene (PCTFE), polytetrafluoroethylene (PTFE), fluorinated ethylene propylene (FEP), and perfluoroalkoxy (PFA). In some embodiments, the fitments 1000 are comprised of any suitable non-plastic material, including, but not limited to, metal, and/or glass, for example. Fitment 1000 can be made by any suitable process, including but not limited to injection molding, or any suitable combination of methods.

Fitments 1000 of the present disclosure may be used with any suitable container and/or dispensing system. In some embodiments, fitments 1000 of the present disclosure may be used with existing container and/or dispensing systems, while in other embodiments, the fitments 1000 may be specifically configured for compatibility with a custom container and dispensing system. A typical container and/or dispensing system that may be used with fitments 1000 of the present disclosure is shown in FIG. 3, though it will be understood that the fitments 1000 of the present disclosure may be used with any suitable liner, container, or other storage and dispensing system and accordingly contain fewer, more, or different components than those illustrated, for example, in FIG. 3.

Figure 3:
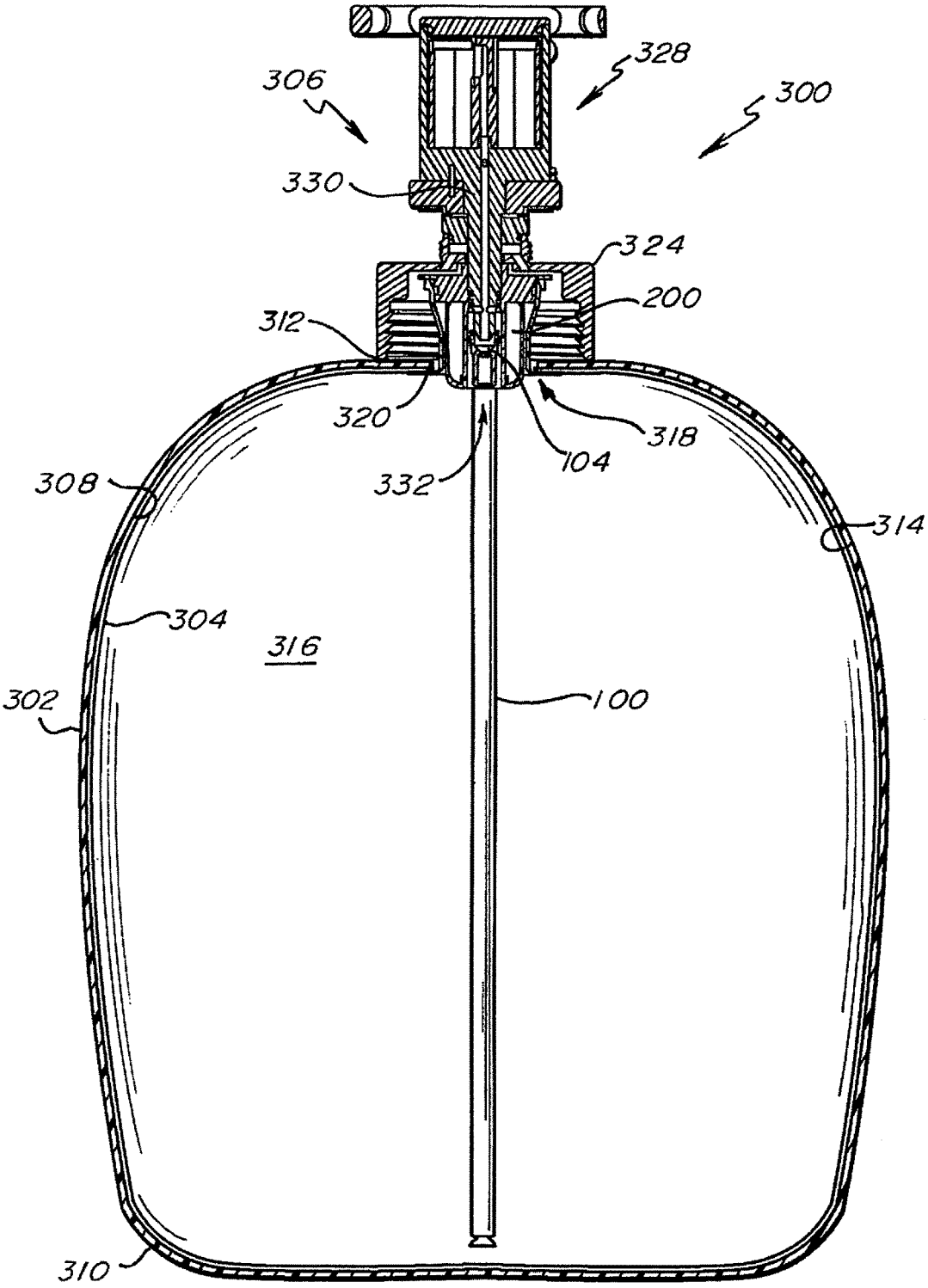
FIG. 3 is a cross-sectional view of a fitment adapter with a dispensing container according to one embodiment of the present disclosure.

Referring to FIG. 3, a container including an overpack 302 and a liner 304 is depicted in an embodiment of the disclosure. The overpack 302 may include an overpack wall 308, an interior cavity 310, and a mouth 312. The overpack 302 may be comprised of any suitable material or combination of materials, for example but not limited to, metal materials, or one or more polymers, including plastics, nylons, EVOH, polyesters, polyolefins, or other natural or synthetic polymers. In further embodiments, the overpack 202 may be manufactured using polyethylene terephthalate (PET), polyethylene naphthalate (PEN), poly(butylene 2,6-naphthalate) (PBN), polyethylene (PE), linear low-density polyethylene (LLDPE), low-density polyethylene (LOPE), medium-density polyethylene (MDPE), high-density polyethylene (HDPE), polypropylene (PP), and/or a fluoropolymer, such as but not limited to, polychlorotrifluoroethylene (PCTFE), polytetrafluoroethylene (PTFE), fluorinated ethylene propylene (FEP), and perfluoroalkoxy (PFA). The overpack 302 may be of any suitable shape or configuration, such as, but not limited to, a bottle, a can, a drum, etc.

The liner 304 can be disposed within the overpack 302. The liner 304 may be configured to comprise any desirable shape that is appealing to the user, and/or assists in the collapse of the liner. The liner 304, in some embodiments, may be dimensioned and shaped to substantially conform to the interior of the overpack 302. In a further embodiment, the liner 304 may have a shape, when inflated or filled, that is different from, but complimentary with, the shape of the overpack 302. The liner 304 may include a liner wall 314, an interior cavity 316, and a mouth 318. The mouth 318 of the liner 304 may include, be welded to, or be integral with a fitment portion 320, such as fitment 1000 of the present disclosure. The fitment portion may be, but need not be, made of a different material than the rest of the liner 304 and may be harder, more resilient, and/or less flexible than the rest of the liner. The fitment portion may couple with one or more components of closures and/or connectors 306, which may be achieved by any suitable means, such as but not limited to, complementary threading, snap-fit or friction-fit means, bayonet means, or any other suitable mechanism or combination of mechanisms for coupling, as will be appreciated by those skilled in the art. In some embodiments, one or more of the closures and/or connectors 306 may couple to, or may also couple to, the mouth 312 of the overpack 302.

In some embodiments, the liner 304 is a collapsible liner that is substantially flexible, such as but not limited to what is commonly referred to as a "pillow liner," while in other embodiments the liner may be somewhat rigid but still collapsible, e.g., a rigid or substantially rigid collapsible liner. In addition, the terms "rigid" and "substantially rigid," in addition to any standard dictionary definitions, are meant to also include the characteristic of an object or material to substantially hold its shape and/or volume, but upon application of such increased or decreased pressure, tend to give, such as by, but not limited to, flexing, bending, etc., rather than breaking. The amount of increased or decreased pressure needed to alter the shape and/or volume of the object or material may depend on the application desired for the material or object and may vary from application to application.

The liner 304 may be manufactured using any suitable material or combination of materials, such as but not limited to, any of the non-metal materials or combination of materials listed above with respect to the overpack 302. However, the overpack 302 and liner 304 need not be manufactured from the same materials. The liner 304 may have one or more layers and may have any desirable thickness. In one embodiment, for example, a liner 304 may have a thickness of from about 0.05 mm to about 3 mm.

The overpack 302 and liner 304 may each be manufactured using any suitable manufacturing process or combination of processes, such as but not limited to, injection blow molding, injection stretch blow molding, extrusion, welding, etc., and may each be manufactured as a single component or may be a combination of multiple components.

Further examples and embodiments of the type of liners, overpacks, and connectors that may be used are disclosed in more detail in: International PCT Appl. No. PCT/US11/

55558, titled, "Substantially Rigid Collapsible Liner, Container and/or Liner for Replacing Glass Bottles, and Enhanced Flexible Liners," filed Oct. 10, 2011; International PCT Appl. No. PCT/US11/55560, titled, "Nested Blow Molded Liner and Overpack and Methods of Making Same," filed Oct. 10, 2011; International PCT Appl. No. PCT/US11/64141, titled "Generally Cylindrically-Shaped Liner for Use in Pressure Dispense Systems and Methods of Manufacturing the Same," filed Dec. 9, 2011; U.S. Prov. Appl. No. 61/703,996, titled "Liner-Based Shipping and Dispensing Systems," filed Sep. 21, 2012; U.S. Prov. Appl. No. 61/468,832, titled "Liner-Based Dispenser," filed Mar. 29, 2011 and related International PCT Appln. No. PCT/US2011/061764, filed Nov. 22, 2011; U.S. Prov. Appl. No. 61/525,540, titled "Liner-Based Dispensing Systems," filed Aug. 19, 2011 and related International PCT Appln. No. PCT/US2011/061771, filed Nov. 22, 2011; U.S. patent application Ser. No. 13/149,844, titled "Fluid Storage and Dispensing Systems and Processes," filed May 31, 2000 U.S. patent application Ser. No. 11/915,996, titled "Fluid Storage and Dispensing Systems and Processes," filed Jun. 5, 2006; International PCT Appl. No. PCT/US10/51786, titled "Material Storage and Dispensing System and Method With Degassing Assembly," filed Oct. 7, 2010; International PCT Appl. No. PCT/US10/41629; U.S. Pat. No. 7,335,721; U.S. patent application Ser. No. 11/912,629; U.S. patent application Ser. No. 12/302,287; International PCT Appl. No. PCT/US08/85264; U.S. patent application Ser. No. 12/745,605, filed Feb. 15, 2011; U.S. Prov. Appln. No. 61/605,011, titled "Liner-Based Shipping and Dispensing System," filed Feb. 29, 2012; and U.S. Prov. Appln. No. 61/561,493, titled "Closure/Connectors for Liner-Based Shipping and Dispensing Containers," filed Nov. 18, 2011, each of which is hereby incorporated by reference herein in its entirety except for express definitions contained therein. The overpack 302 and liner 304 may include any of the embodiments, features, and/or enhancements disclosed in any of the above noted applications, including, but not limited to, flexible, rigid collapsible, 2-dimensional, 3-dimensional, welded, molded, gusseted, and/or non-gusseted liners, and/or liners that contain folds and/or liners that comprise methods for limiting or eliminating choke-off and liners sold under the brand name NOWpak® by ATMI, Inc. for example. Various features of dispensing systems disclosed in embodiments described herein may be used in combination with one or more other features described with regard to other embodiments.

A fitment adapter of the present disclosure may be particularly useful where relatively large to very large containers may be used. Large containers often have corresponding relatively large openings in the fitment portion of the liner and/or the mouth of the overpack may be correspondingly relatively large. However, the dimensions for standard dip tubes and/or dip tube couplers may be too small to permit secure coupling with the fitment of a large liner, for example. Accordingly, a fitment adapter may allow for a secure fit between the dip tube coupler and fitment liner to be achieved. The dimensions of the fitment adapter may be configured to conform to a particular liner fitment and/or to a particular dip tube coupler.

Fitment adapters of the present disclosure may also provide protection for the dip tube assembly at the point at which the dip tube assembly is subjected to the most stress, i.e. where the coupler and dip tube portion are connected and/or toward the top of the liner where the walls of the liner and the fitment meet, for example. Further, in some embodiments, the fitment adapter may help protect the walls of the liner from stresses that may lead to tears or other weakening of the liner walls. The cup portion of the adapter (which will be discussed in detail below) may generally keep the walls of the liner from closely collapsing around the dip tube assembly during dispense. This may be advantageous because when the liner collapses tightly around the dip tube, it may trap liquid within folds of the liner, thereby decreasing the dispense rate. Accordingly, keeping the liner from closely collapsing around the dip tube may be beneficial. Further, the fitment adapter may prevent the walls of the liner from becoming trapped or pinched in the fitment itself, which could result in tears in the liner.

As described above, the fitment adapters of the present disclosure may be configured to receive a dip tube assembly therein. As previously discussed with respect to FIG. 1, a dip tube assembly 100 according to the present disclosure may include a tubular portion 102 and a coupler portion 104. The coupler portion 104 may be coupled with or integral with the tubular portion 102. The coupler portion 104 may take on various configurations, but is generally configured at one end to cooperate in fluid communication with a top end of the tubular portion 102 and, in some embodiments, at the other end to substantially fit into, or adjacent to, the mouth of a particular liner or other container, such as by fitting into or adjacent to, or otherwise coupling with, a fitment adapter. The fitment adapter, in turn, may be configured to couple with the fitment portion of a liner, such as but not limited to those fitments described herein. In this regard, the fitment adapter may be configured to cooperate, or fit, with any suitable liner or container while standard dip tube or dip tube assemblies may be used. Similarly, the fitment adapter may be configured to cooperate, or fit, with any suitable dip tube coupler 104, thus permitting flexible use of tubular portion 102 with any particular model container or other custom container.

Figure 2A:
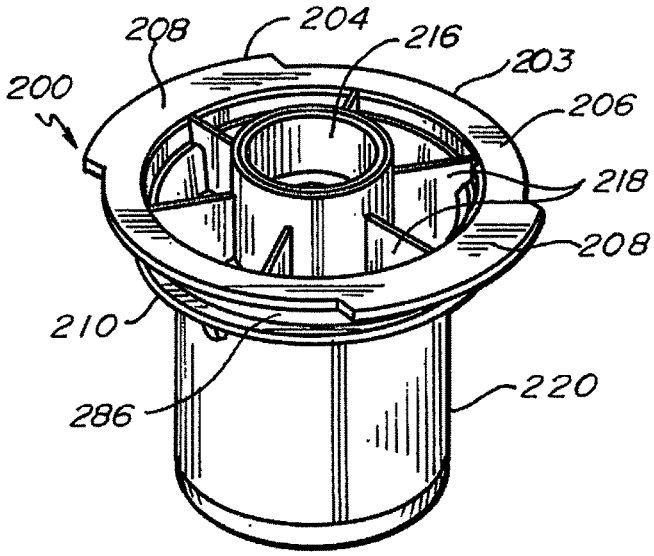
FIG. 2A is a perspective view of a fitment adapter according to one embodiment of the present disclosure.
Figure 2B:
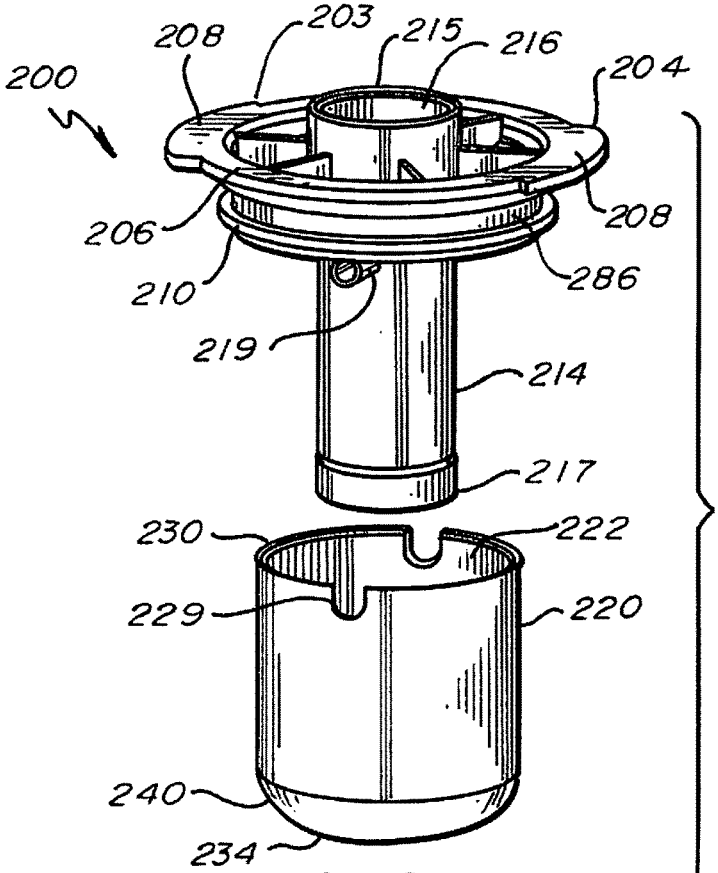
FIG. 2B is an exploded view of the fitment adapter of FIG. 2A, according to one embodiment of the present disclosure.

Referring to FIGS. 2A and 2B, a fitment adapter 200 generally be configured to couple with the dip tube coupler 104, as well as the fitment of a liner and/or mouth of an overpack, is depicted in an embodiment of the disclosure. The fitment adapter 200 comprises two coupleable portions, including a stem portion 204 and a cup or "shroud" portion 220. It is understood that the two coupleable portions is non-limiting; that is, any of the fitment adapters disclosed herein can be a single unitary piece.

The stem portion 204 may include a rim 206 and a post 214, the post 214 being operably coupleable to and axially aligned with the rim 206. The rim 206 may be generally disc shaped, including a top surface 203 with a given width "W." In various embodiments, the rim 206 includes one or more flanges 208 extending radially therefrom. The flanges 208 may be configured to couple with or otherwise rest above the fitment of a liner and/or the mouth of an overpack. The flanges 208 can also be used to engage a removal tool, in some cases, for removal of the fitment adapter. The one or more flanges 208 may have any suitable dimensions, and may be positioned at any suitable point along the rim 206. In some embodiments, two flanges 208 may be positioned generally opposite one another around the circumference of the rim 206, as depicted in FIGS. 2A and 2B.

In one embodiment, the rim 206 includes one or more concentric ribs 210 positioned below the top surface 203. The ribs 210 may have a smaller circumference than the top surface 203, and may be positioned so as to define a receiving area 286 for an O-ring or other seal. The O-ring may be any suitable O-ring and may allow for a liquid tight seal to be formed between the fitment adapter 200 and the fitment of the liner. The size and shape of the rim 206, including any flanges 208 or ribs 210, may be specifically configured to couple with the size and/or shape of a particular liner fitment and/or overpack mouth.

The post 214 of the stem portion 204 may be generally tubular with the walls of the post 214 forming an interior cavity 216, a top end 215 and a bottom end 217. The walls of the post 214 may have a uniform thickness or a variable thickness. In embodiments, where the walls of the post 214 are generally uniform, the geometry of the exterior walls of the post 214 may generally be the same as, or complimentary with, the geometry of the interior walls of the post 214. However, where the thickness of the walls of the post 214 have a variable thickness, the geometry of the exterior walls of the post 214 may be different than the geometry of the interior walls of the post 214. For example, the exterior walls of the post 214 may be generally cylindrical with a uniform circumference from the top end 215 to the bottom end 217, while the interior walls of the post 214 may have two or more different circumferences at different locations along the length of the post, thereby creating one or more features, such as ridges, bumps, ledges, ramps, and/or segments, as will be discussed further below. Such features that may be formed in the interior cavity 216 of the post 214 may be used to secure the dip tube, the dip tube coupler, the connector probe, or some portion(s) thereof, which will be discussed further below with reference to specific embodiments. Generally, however, the circumference (whether uniform or varying) of the interior cavity 216 of the post 214 may be configured to allow for the insertion of at least some portion of a dip tube assembly. In some embodiments the interior cavity 216 may be configured to also allow for the removal of the dip tube assembly, while in other embodiments, the interior cavity may be configured to substantially prohibit removal of the dip tube assembly.

In some embodiments, the stem 204 is a single unitary piece that comprises both the rim 206 and the post 214. In other embodiments, the stem 204 includes two or more operably connectable pieces that form the rim and the post. The top end 215 of the post 214 may be flush with the top surface 203 in some embodiments; or as depicted in FIGS. 2A and 2B, the top end 215 of the post 214 may extend above the top surface 203 of the rim 206. In other embodiments, the top end 215 of the post 214 may be positioned at any suitable height relative to the top surface 203 of the rim 206, including positioning the top end 215 of the post 214 lower than the top surface 203 of the rim 206. One or more spokes 218 may operably couple the rim 206 to the post 214. While a plurality of spokes 218 are shown and described, it will be understood that any suitable means of coupling the post and rim may be used, including attachment pieces of any other size, shape, and/or number.

In some embodiments, the stem 204 may include one or more headspace gas removal and/or escape features 219. Generally, the expression "headspace," as used herein, may refer to the gas space in a liner or other container that may rise to the top of the liner/container, above the contents stored therein. This gas may contaminate and therefore damage the contents stored in the liner. As such, it may be advantageous to remove any headspace gas prior to dispensing the contents of a container. In some embodiments the gas removal and/or escape features 219 may be located as high as possible in the fitment adapter so as to allow for as much of the gas possible to escape or be removed from the system. The gas removal features 219 may also beneficially allow gas to escape from the system as gas is released from folds or pockets that may form in a liner as the container is moved during transit, or during dispense, for example. Further, in some embodiments, the gas removal features 219 may allow the package to vent during shipping. Because the pressure in a filled container may change during transit as a result of a change in temperature or altitude, for example, a gas removal port 219 may also advantageously function as a vent to relieve pressure in the system in the event of an increase in pressure, thereby minimizing or eliminating the risk of the contents erupting when a seal on the container is broken in order to dispense the contents of the container, for example. In the embodiment shown in FIG. 2B, the headspace feature includes a cross port 219. The cross port 219 arms may be generally hollow, thereby creating a passageway that may connect the interior of the liner to the exterior of the liner, through which the headspace gas may escape. In other embodiments, however, the headspace feature may be something other than a cross port, embodiments of which will be discussed further below.

The fitment adapter 200 may also include a cup or shroud portion 220. The cup portion 220 may be generally cup-shaped with side walls that define an interior cavity 222, a top edge 230, and a bottom edge 234. The side walls may define a top edge 230 that may be generally configured to couple with the top and/or ribs 210 of the rim 206. The cup portion 220 may couple with the rim 206 of the stem by any suitable method, including, but not limited to snap fit, friction fit, bayonet fit, complimentary threading, or any other suitable method, or combination of methods. Accordingly, the top edge 230 of the cup portion 220 may include features for coupling to the rim 206 of the stem portion. For example, the top edge 230 of the cup may include threading, indentations, protrusions or any other feature or combination of features that may couple with complimentary features on the rim 206.

In some embodiments, the side walls of the cup portion 220 may have a generally uniform thickness and uniform circumference from the top edge 230 to the bottom edge 234. In other embodiments, however, the side walls may have varying thicknesses. Further, the circumference of the side walls may not be uniform from the top edge 230 to the bottom edge 234, in some embodiments. For example, as depicted in FIGS. 2A and 2B, the circumferences of the side walls may taper inward 240 near the bottom edge 234 of the cup portion. While a tapered embodiment is shown, it will be understood that the cup or any portion thereof may have any suitable geometry. Further, the length (that is the distance between the top edge 230 and the bottom edge 234) of the cup, may be any suitable length. In some embodiments, as will be further described below, the length of the cup 220 may be configured to accommodate the entirety of a dip tube coupler 104, for example. While in other embodiments, the length of the cup 220 may be configured to only accommodate a portion of a dip tube and/or the dip tube coupler.

The bottom edge 234 of the cup portion 220 may define an opening having a given diameter. In some embodiments, the opening defined by the bottom edge 234 may have a smaller circumference than the opening defined by the top edge 230. However, it will be understood that the circumference of the openings defined by the top edge 234 and the bottom edge 234 may be any suitable circumference, and in some cases, the circumferences may be the same. In some embodiments, the opening at the bottom edge 234 of the cup 220 may be generally the same as, or slightly larger than, the circumference of the bottom end 217 of the post 214, such that the bottom end 217 of the post 214 may fit inside of the opening defined by the bottom edge 234 of the cup portion 220 when the cup 220 and stem 204 are coupled together. In some embodiments, the bottom end 217 of the post 214, and the bottom edge 234 of the cup portion 220 may include features for coupling to one another. For example, coupling features may include complimentary threading, or may include features for coupling by snap fit, friction fit, or any other suitable mechanism, or combination of mechanisms for coupling.

The cup portion 220 may also have additional features. For example, for embodiments where the stem portion 204 includes a headspace gas cross port 219, the cup portion 220 may include receiving slots 229 to receive the arms of the cross port 219. In this way, the hollow ends of the arms of the cross port may be exposed to any headspace gas that may be trapped at the top of the interior of the liner, thereby allowing such gas to be removed from the dispensing system through the cross port arms.

Like the fitments described above, the fitment adapter 200 may be comprised of any suitable material, or combination of materials, including any suitable plastic, for example, but not limited to one or more polymers, including plastics, nylons, EVOH, polyesters, polyolefins, or other natural or synthetic polymers. In further embodiments, the fitment adapter 200 may be manufactured using polyethylene terephthalate (PET), polyethylene naphthalate (PEN), poly (butylene 2,6-naphthalate) (PBN), polyethylene (PE), linear low-density polyethylene (LLDPE), low-density polyethylene (LDPE), medium-density polyethylene (MDPE), high-density polyethylene (HDPE), polypropylene (PP), and/or a fluoropolymer, such as but not limited to, polychlorotrifluoroethylene (PCTFE), polytetrafluoroethylene (PTFE), fluorinated ethylene propylene (FEP), and perfluoroalkoxy (PFA). In other embodiments, one or more portions of the fitment adapter may be comprised of any suitable non-plastic material, including, but not limited to, metal, and/or glass, for example. Portions of the fitment adapter 200 may be comprised of the same or different materials. The fitment adapter can be made from any suitable process including injection molding, blow molding, injection stretch blow molding, extrusion, or any other suitable method or combination of methods.

Fitment adapters 200 of the present disclosure may be used with any suitable container and/or dispensing system, such as the container and/or dispensing systems described above with respect to fitments. That is in some embodiments, fitment adapters 200 of the present disclosure may be used with existing container and/or dispensing systems, while in other embodiments, the fitment adapters 200 may be specifically configured for compatibility with a custom container and dispensing system. FIG. 3 again illustrates a typical container and/or dispensing system that may be used with fitment adapters 200 of the present disclosure, though it will be understood that the fitment adapter of the present disclosure may be used with any suitable container or storage and dispensing system and accordingly contain fewer, more, or different components than those illustrated, for example, in FIG. 3.

As previously described, such a container and/or dispensing system 300 may include an overpack 302, a liner 304. Such container and/or dispensing systems 300 may also include one or more closures and/or connectors 306, a dip tube or dip tube assembly 100, and a fitment adapter 200, in accordance with various embodiments of the present disclosure. The fitment adapter 200 may be configured to fit inside the fitment portion 320, which may but need not be fitment 1000, and in some cases, couple therewith. The fitment adapter 200 and/or fitment portion 320 (as described above) may couple with one or more components of closures and/or connectors 306, which may be achieved by any suitable means, such as but not limited to, complementary threading, snap-fit or friction-fit means, bayonet means, or any other suitable mechanism or combination of mechanisms for coupling, as will be appreciated by those skilled in the art. In some embodiments, one or more of the closures and/or connectors 306 may couple to, or may also couple to, the mouth 312 of the overpack 302.

As previously described, the overpack 302 and liner 304 may each be manufactured using any suitable manufacturing process or combination of processes, such as but not limited to, injection blow molding, injection stretch blow molding, extrusion, welding, etc., and may each be manufactured as a single component or may be a combination of multiple components. In some embodiments, the overpack 302 and liner 304 may be blow molded in a nested fashion, also referred to herein as co-blow molded. Examples of liner-based systems and methods utilizing co-blow molding techniques have been described in greater detail in International PCT Appl. No. PCT/US11/55560, titled, "Nested Blow Molded Liner and Overpack and Methods of Making Same," filed Oct. 10, 2011, which is hereby incorporated herein by reference in its entirety except for express definitions contained therein. In some embodiments a liner may be blow molded into an already formed overpack, whereby the overpack may function as the mold for the liner, and may be referred to herein as "dual blow molding." In such embodiments, the overpack may be manufactured by any suitable process.

Example connectors 306 may include but are not limited to, a cap 324 or other closure, and a dispense connector 328, having a probe 330 for operably coupling the dispense connector in fluid communication with the interior passageway 332 of a coupler portion 104 of a dip tube assembly 100 and/or the fitment portion 320 and/or fitment adapter 200 in accordance with various embodiments of the present disclosure.

Generally, a liner 304 may be disposed within an overpack 302, by any suitable means, wherein the fitment portion 320 of the liner and the mouth 312 of the overpack may be generally aligned, with the fitment portion 320 of the liner positioned inside of the mouth 312 of the overpack. The dip tube or dip tube assembly 100 may be inserted into the fitment 320 and/or fitment adapter 200 (as will be discussed more fully below, via the opening defined by the bottom edge 217 of the post 214 in some embodiments, while in other embodiments, via the top end 215 of the post 214). In embodiments, where a fitment adapter is utilized, once the dip tube/dip tube assembly 100 has been inserted into the fitment adapter 300, the fitment adapter may be positioned within the dispensing container 302, 304 such that the dip tube/dip tube assembly 100 extends into the interior cavity 316 of the liner 304 and the rim 206 of the fitment adapter 200 is coupled with the liner fitment portion 320. In other embodiments, the fitment adapter 200 may be positioned in the dispensing container and then the dip tube/dip tube assembly may be positioned in the fitment adapter 200. Regardless of whether a fitment adapter is used, the dip tube/dip tube assembly 100 extends into the interior cavity 316 of the liner 304. The probe 330 of the connector 328 may be inserted into the fitment portion 320 or in embodiments where a fitment adapter is used, may be inserted into the top end 215 of the post 214 of the fitment adapter 200, in order to ensure a fluid communication path from the interior cavity 316 of the liner through the dip tube/dip tube assembly 100, through the post 214 of the fitment adapter where appropriate, and to the probe 330 of the connector 328, such that the contents of the liner may be dispensed.

Figure 4:
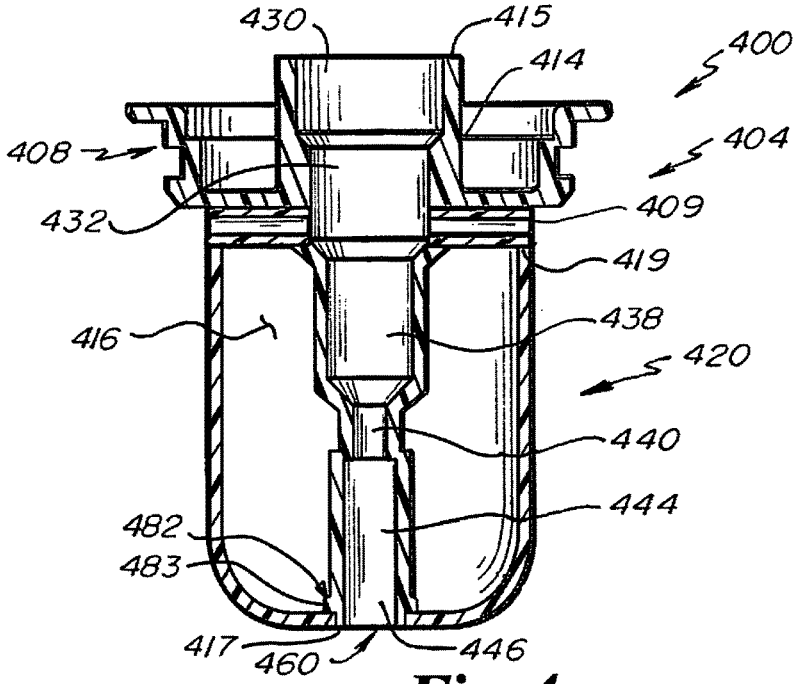
FIG. 4 is a cross-sectional view of a fitment adapter according to one embodiment of the present disclosure.

Referring to FIG. 4, a fitment adapter 400 is depicted in an embodiment of the disclosure. The fitment adapter 400 includes a stem portion 404 and a cup portion 420. The stem portion 404 includes a rim 408 and a post 414. In contrast to post 214 of FIG. 2, the post 414 does not have a uniform circumference from the top end 415 to the bottom end 417 of the post 414. Instead, the circumference of the walls of the post 414 may vary to create an interior cavity 416 comprising a plurality of segments having different circumferences 430, 432, 438, 440, 444, 446. The interior post segment 444 may include a bracket 482 that may secure the post 414 to the cup portion 420. The bracket 482 may have a retention ledge 483 that couples the post 414 to the cup 420 in a snap-fit configuration. However, in other embodiments, other coupling methods may be used, including, but not limited to press fit, bayonet fit, and complimentary threading.

The cup portion 420 of the fitment adapter 400 of FIG. 4 is generally the same as that of FIGS. 2A and 2B. For embodiments where the fitment adapter is comprised of two portions, the cup portion 420 and the stem portion 404 can be coupled together in any suitable fashion, for example by complimentary threading, snap-fit, friction fit, or any other suitable method, or combination of methods.

A dip tube, which may further include a dip tube coupler 104, as described previously, may be inserted through the opening 460 provided in the bottom of the cup 420 and post 414. The dip tube and/or dip tube assembly may be generally hindered or prevented from being inserted past segment 444 into segment 440 because of the narrower circumference of segment 440.

In use, the cup 420 and the stem 404 of the fitment adapter 400 may be coupled together. The dip tube/dip tube assembly may be inserted through opening 460 into segment 444 of the post. The fitment adapter 400 may be positioned in the fitment of the liner in preparation for dispense of the contents of the liner, for example.

Figure 5:
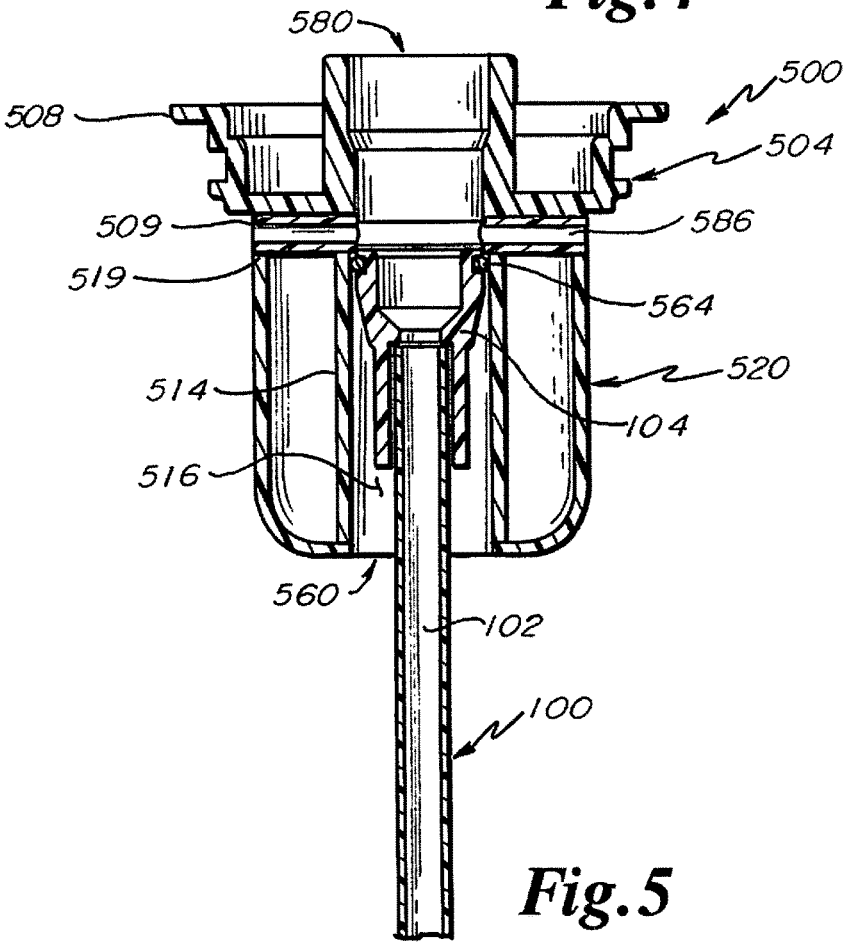
FIG. 5 is a cross-sectional view of a fitment adapter according to another embodiment of the present disclosure.

Referring to FIG. 5, a fitment adapter 500 is depicted in an embodiment of the disclosure. The fitment adapter 500 includes a cup portion 520 and a stem portion 504, the stem portion 504 including a post 514 and a rim 508. The depicted embodiment includes an interior portion 516 of the post that is of a generally uniform circumference for at least the length of the post that is positioned within the cup portion 520. In some embodiments, a dip tube 102 and a dip tube coupler 104 is inserted into the post 514 of the fitment adapter. In one embodiment, the dip tube assembly 100 can be inserted through the top opening 580 of the post. An O-ring 564 or other seal positioned about the dip tube coupler 104 can be included that compresses to create a tight fit as the coupler 104 is pushed past the hard stop 586 where the circumference of the post narrows to a diameter that is smaller than the diameter of the dip tube coupler 104, thereby creating a tight fit within the interior of the post. Thus, the hard stop 586 may help support the dip tube in the post, and may further help to create a seal, and in some cases an air tight seal. In some embodiments, the dip tube assembly is inserted through the opening 560 in the bottom of the post.

Because there is nothing preventing the dip tube assembly 100 from being removed through the bottom opening 560 of the post, the dip tube assembly 100 may be removed after use through the bottom opening 560, for possible reuse. The fitment adapter 500 can include a headspace gas cross port 509 and receiving slots 519, of the type that were generally described above with regard to other embodiments of fitment adapters.

In use, for various embodiments, the cup 520 and the stem 504 of the fitment adapter 500 are coupled together. In one embodiment, the dip tube/dip tube assembly 100 can be inserted through opening 560 in the bottom of the post until the dip tube assembly 100 is prevented from going any further, i.e. until the dip tube assembly 100 abuts the stopping point 586. The fitment adapter 500 can, in various embodiments, be positioned in the fitment of the liner in preparation for dispense of the contents of the liner, for example. If desired, the dip tube assembly 100 can, in some embodiments, be removed through the opening 560 in the bottom of the post after use.

Figure 7:
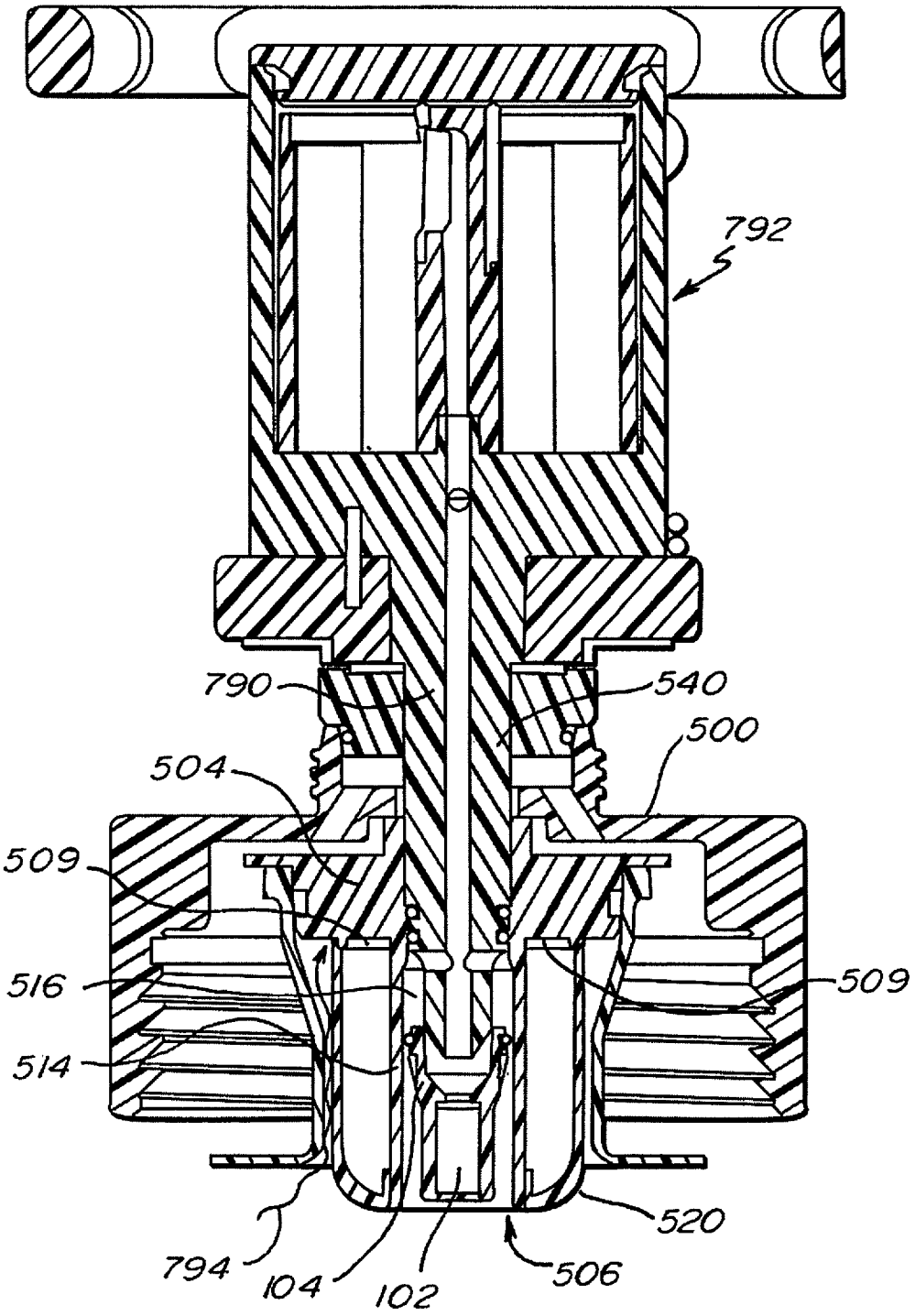
FIG. 7 is a cross-sectional view of the fitment adapter of FIG. 5.

Referring to FIG. 7, the fitment adaptor 500 is depicted in assembly with a probe 790 of a connector 792 in an embodiment of the disclosure. By this arrangement, the headspace gas can travel from the interior of the container, in between the fitment of the liner and the exterior of the fitment adapter, as shown by the arrows on path 794. The headspace gas can then exit the fitment adapter via the arms of the cross port 509. Because the headspace gas may be lighter than air in some cases, the gas will rise to the highest point. Accordingly, in some embodiments, the headspace gas features can be located as high as possible on the fitment adapter. It will be understood, however, that in other embodiments, the headspace gas features may be positioned at any suitable place on the fitment adapter.

Figure 6:
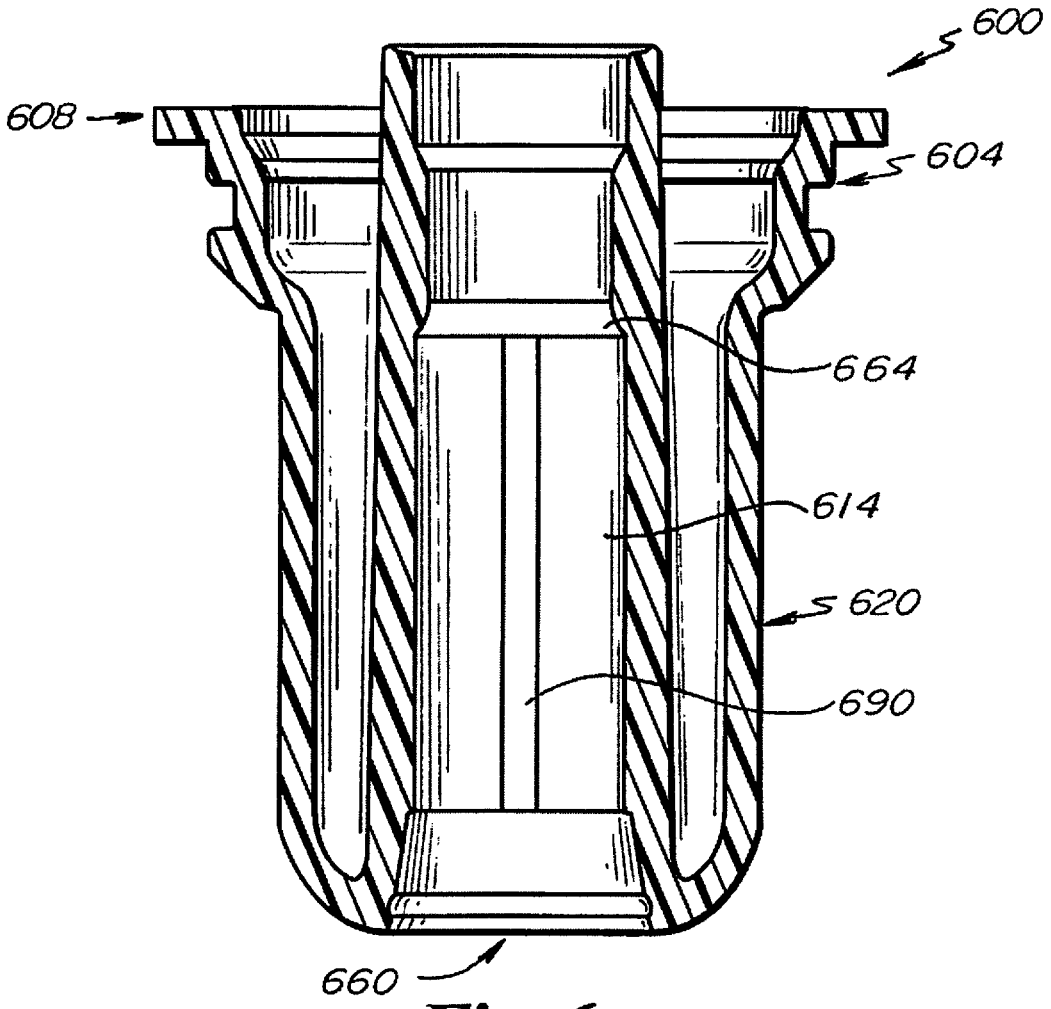
FIG. 6 is a cross-sectional view of a fitment adapter according to a further embodiment of the present disclosure.

As described herein, any of the fitment adapters may be a single unitary piece, as shown, for example in the fitment adapter 600 of FIG. 6, wherein the cup portion 620 and the stem portion 604, are molded together as a single piece. In other embodiments, the fitment adapter 600 can comprise two or more separate but coupleable pieces, e.g. the cup portion 620 may be separate from the stem portion. Headspace gas may be removed by means of headspace gas port groove(s) 690 provided in the side walls of the post 614. The walls of the post 614 may include one or more grooves 690 for headspace gas removal. In various embodiments, the groove(s) run the vertical length of the portion of the post positioned in the cup portion 620, thereby providing a path for the headspace gas to escape from the liner to outside of the fitment adapter. The groove(s) 690 may have any suitable width, including a width that varies along the vertical length of the groove, in some embodiments. In one embodiment, the dip tube 102 and/or dip tube coupler 104 is inserted through the opening in the bottom of the post 660 up to a stopping ledge 664 provided in the interior portion of the post 614. The dip tube and/or dip tube assembly can be coupled to the interior of the post by, for example, a press fit. However, in other embodiments, any other method of securing the dip tube and/or dip tube coupler within the post may be used, for example but not limited to snap fit, complementary threading, bayonet fit, or any other suitable method or combination of methods.

In use, the dip tube/dip tube assembly 100 may be inserted through the opening 660 in the bottom of the post until the dip tube assembly 100 is prevented from going any further, i.e. until the dip tube assembly 100 abuts the stopping point 664. The fitment adapter 600 may be positioned in the fitment of the liner in preparation for dispense of the contents of the liner, for example. If desired, the dip tube assembly 100 may be removed through the opening 660 in the bottom of the post after use.

Figure 8:
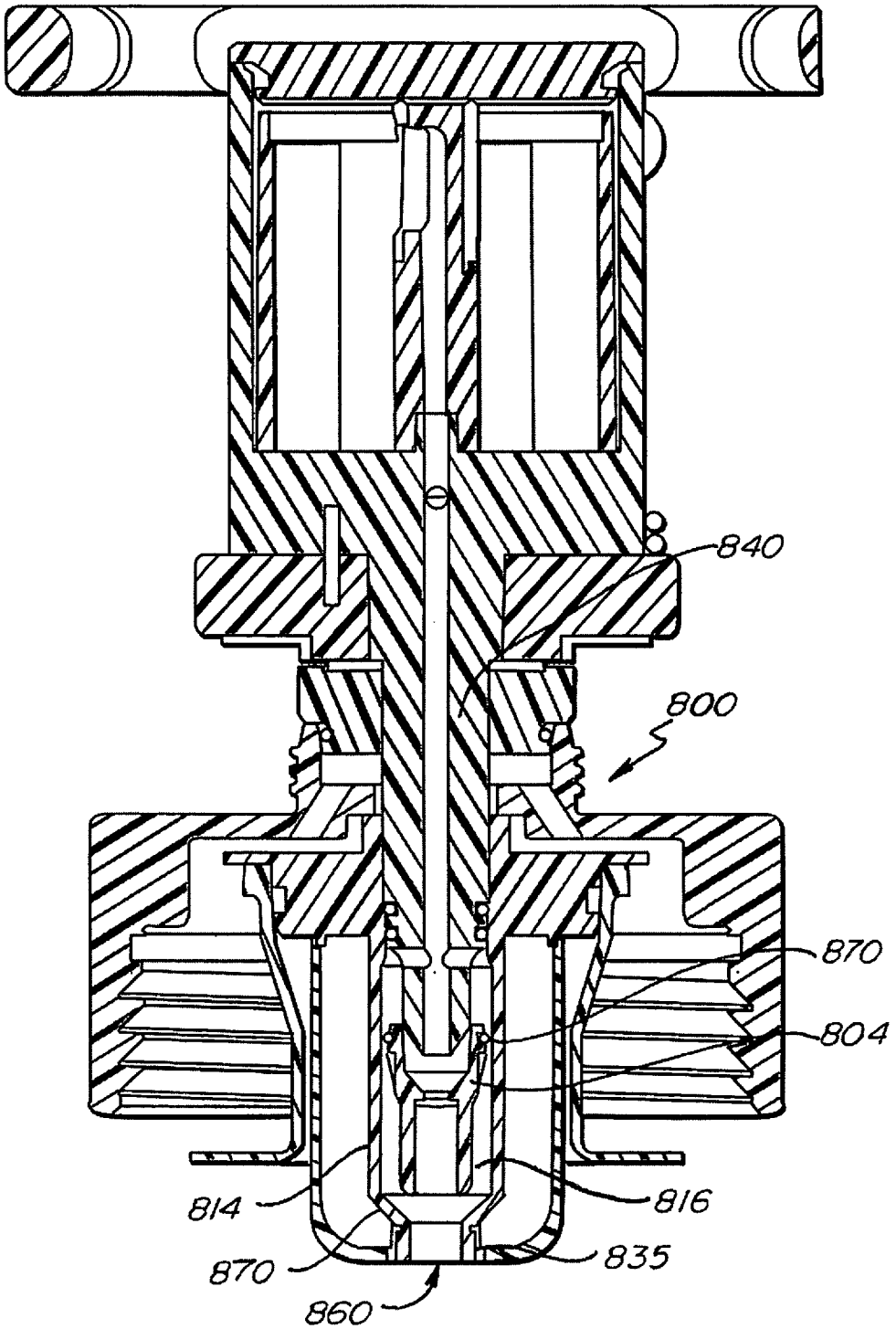
FIG. 8 is a cross-sectional view of a fitment adapter according to still another embodiment of the present disclosure.

Referring to FIG. 8, a fitment adapter 800 is depicted in an embodiment of the disclosure. In the depicted embodiment, a post 814 defines an interior cavity 816 that tapers or narrows toward the bottom of the post 814 to create a smaller circumferential segment 835. Generally, the larger interior cavity 816 has a diameter that is large enough for a dip tube coupler 804 to be positioned therein, whereas the smaller circumferential segment 835 has a diameter that is smaller than the diameter of the largest part of the dip tube coupler 804. In one embodiment, the dip tube assembly, including the dip tube coupler 804, is inserted into the post through the opening in the top 840 of the post. The interior cavity of the post 814 can include a stopping ledge 864, which may generally be a ledge or ridge formed in the interior cavity of the post where the diameter becomes slightly smaller.

In one embodiment, the dip tube coupler includes an O-ring 870. As the dip tube coupler 804 is pushed down through the opening 840 in the top of the post 814, the dip tube coupler 804 and O-ring 870 flex inward. The material of the coupler 804 and/or the material of the O-ring 870 may allow for the coupler 804 to flex enough to be inserted through the interior cavity of the post, past the stopping ledge 864. The O-ring 870 and/or the coupler 804 may be comprised of a rubber or plastic material, for example, that provides some flexibility. It will be understood, however, that any suitable material or combination of materials may be used to make the O-ring 870 and the coupler 804. The O-ring 870 and the coupler can be comprised of the same or different materials. The dip tube tubular portion 102 may extend from the end of the coupler 804 through the opening 860 in the bottom of the post 814. In the depicted embodiment, the dip tube coupler 804 is too large to fit through the opening 860 in the bottom of the post 814. Accordingly, in various embodiments, the dip tube coupler 804, once properly placed for use in the post 814, cannot be removed as a result of the stopping ledge 864 being above the coupler 804 and the smaller circumferential segment 835 being below the coupler 804.

In use, the dip tube/dip tube assembly 100 may be inserted through the opening 840 in the top of the post until the dip tube assembly 100 is prevented from going any further, i.e. until the dip tube assembly 100 abuts the stopping ledge 864. The fitment adapter 800 may be positioned in the fitment of the liner in preparation for dispense of the contents of the liner, for example.

Figure 9:
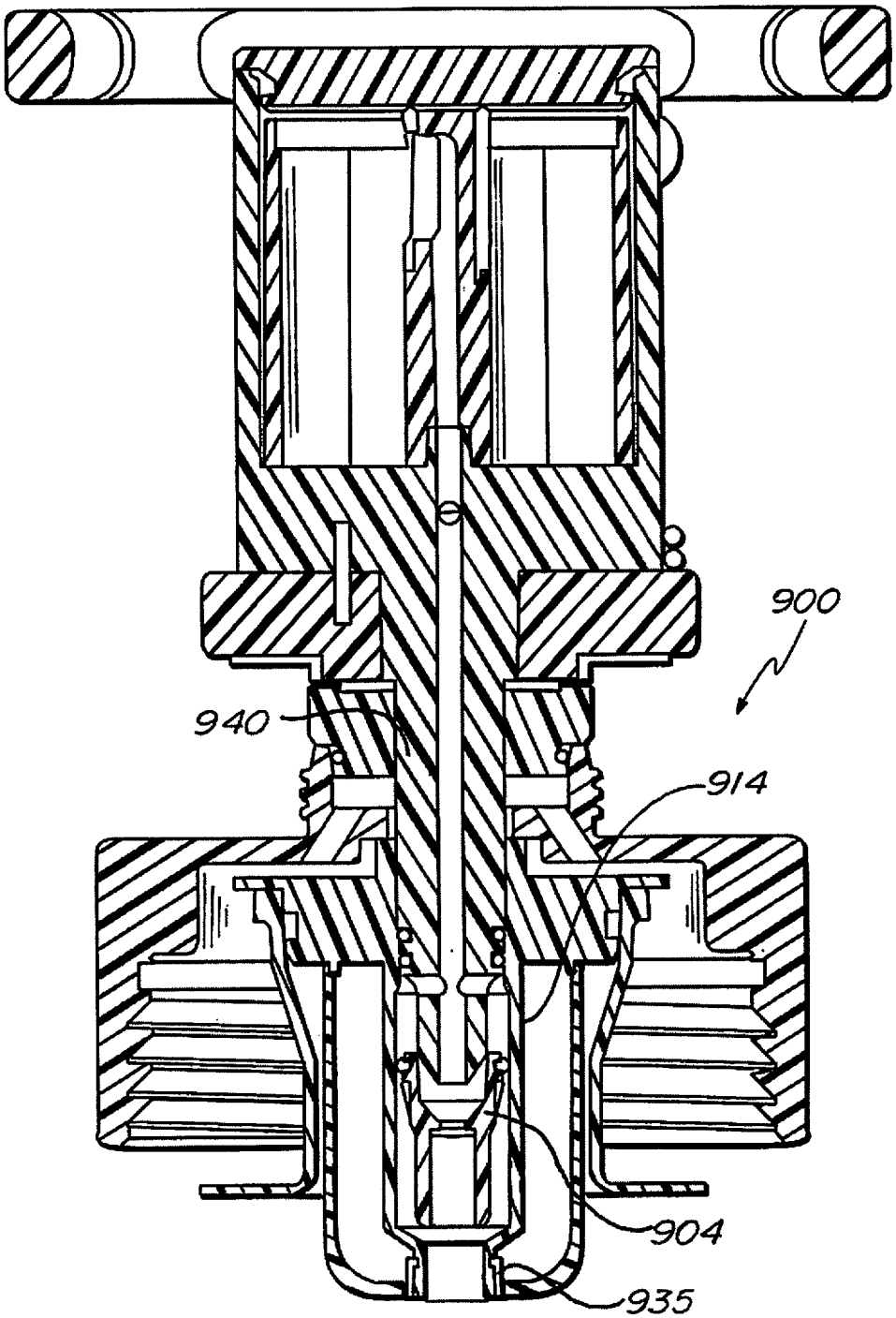
FIG. 9 is a cross-sectional view of a fitment adapter according to yet a further embodiment of the present disclosure.

Referring to FIG. 9, a fitment adaptor 900 is depicted in an embodiment of the disclosure. The fitment adaptor 900 is a variation of the fitment adapter 800 of FIG. 8. The interior cavity 914 of the post has a tapered end that forms a smaller circumferential segment 935 that has a generally smaller diameter than the dip tube coupler 904. However, unlike the fitment adapter 800, the rest of the post 914 has a generally uniform circumference, i.e. there is no stopping ledge in this embodiment. Accordingly, the dip tube assembly could be removed through the opening 940 in the top of the post 914 if desired.

While each feature of fitment adapters of the present disclosure may not be described with specific reference to every embodiment, it is recognized and considered within the scope of the present application, that any of the features, or combination of features, described with regard to any one of the embodiments shown in FIGS. 4-9 are applicable to, and may be incorporated into, any of the other embodiments of fitment adapters. For example only, any of the embodiments may use tapering in the interior cavity of the post to prevent removal of the dip tube assembly via the opening in the bottom of the post. Furthermore, any of the embodiments may utilize any of the various headspace gas removal features disclosed herein.

Any of the fitment adapters of the present disclosure, or the various components thereof, such as the cup portion, stem portion, or any other additional components, may be manufactured using any suitable manufacturing process, such as but not limited to, injection molding, injection blow molding, injection stretch blow molding, extrusion, etc. In some embodiments, the cup portion and stem portion may be manufactured separately, as separate components, while in other embodiments, they may be manufactured as a single, unitary component.

The various embodiments of fitments and fitment adapters for use with container and/or dispensing systems described herein may be utilized with any suitable dispense process. For example, the various embodiments described herein may be utilized in pressure dispense processes, including direct and indirect pressure dispense, pump dispense, and pressure-assisted pump dispense, including various embodiments of inverted dispense methods disclosed in Korean patent registration no. 10-0973707, titled "Apparatus for Supplying Fluid," which is hereby incorporated by reference herein in its entirety except for express definitions contained therein.

Examples of some of the types of materials that may be stored, shipped, and/or dispensed using embodiments of the present disclosure include, but are not limited to: ultrapure liquids, such as acids, solvents, bases, photoresists, slurries, detergents, cleaning formulations, dopants, inorganic, organic, metalorganics, TEOS, and biological solutions, DNA and RNA solvents and reagents, pharmaceuticals, printable electronics inorganic and organic materials, lithium ion or other battery type electrolytes, nanomaterials (including for example, fullerenes, inorganic nanoparticles, sol-gels, and other ceramics), and radioactive chemicals; pesticides/fertilizers; paints/glosses/solvents/coating-materials etc.; adhesives; power washing fluids; lubricants for use in the automobile or aviation industry, for example; food products, such as but not limited to, condiments, cooking oils, and soft drinks, for example; reagents or other materials for use in the biomedical or research industry; hazardous materials used by the military, for example; polyurethanes; agrochemicals; industrial chemicals; cosmetic chemicals; petroleum and lubricants; sealants; health and oral hygiene products and toiletry products; or any other material that may be dispensed by pressure dispense, for example. Materials that may be used with embodiments of the present disclosure may have any viscosity, including high viscosity and low viscosity fluids. Those skilled in the art will recognize the benefits of the disclosed embodiments, and therefore will recognize the suitability of the disclosed embodiments to various industries and for the transportation and dispense of various products. In some embodiments, the disclosed embodiments may be particularly useful in industries relating to the manufacture of semiconductors, flat panel displays, LEDs, and solar panels; industries involving the application of adhesives and polyamides; industries utilizing photolithography technology; or any other critical material delivery application. However, the various embodiments disclosed herein may be used in any suitable industry or application.

After dispense is completed or substantially completed and the liner is empty or substantially empty, the end-user may dispose of the liner, fitment, and/or fitment adapter and/or recycle some or all components of the fitment or fitment adapter. In order to assist in making the fitments or fitment adapters described herein more sustainable, the fitments or fitment adapters or one or more components thereof, in some embodiments may be manufactured from biodegradable materials or biodegradable polymers, including but not limited to: polyhydroxyalkanoates (PHAs), like poly-3-hydroxybutyrate (PHB), polyhydroxyvalerate (PHV), and polyhydroxyhexanoate (PHH); polylactic acid (PLA); polybutylene succinate (PBS); polycaprolactone (PCL); polyanhydrides; polyvinyl alcohol; starch derivatives; cellulose esters, like cellulose acetate and nitrocellulose and their derivatives (celluloid); etc. Similarly, in some embodiments, and if suitable for the industry application, the fitments or fitment adapters or one or more components thereof, may be manufactured from materials that can be recycled or recovered, and in some embodiments, used in another process by the same or a different end user, thereby allowing such end user(s) to lessen their impact on the environment or lower their overall emissions. For example, in one embodiment, the fitments or fitment adapters or one or more components thereof may be manufactured from materials that may be incinerated, such that the heat generated therefrom may be captured and incorporated or used in another process by the same or different end user. In general, the fitments or fitment adapters or one or more components thereof may be manufactured from materials that can be recycled, or that may be converted into raw materials that may be used again.

In the foregoing description various embodiments have been presented for the purpose of illustration and description. They are not intended to be exhaustive or to limit the invention to the precise form disclosed. Obvious modifications or variations are possible in light of the above teachings. The embodiments were chosen and described to provide the best illustration of the principals of the invention and its practical application, and to enable one of ordinary skill in the art to utilize the same in various embodiments and with various modifications as are suited to the particular use contemplated. All such modifications and variations are within the scope of the invention as determined by the appended claims when interpreted in accordance with the breadth they are fairly, legally, and equitably entitled.

What is claimed is:

1. A fitment assembly, comprising:

a fitment for defining a rigid fluid pathway between an interior and an exterior of a container, the fitment including:

a tubular body having an upper neck portion and a lower neck portion, said lower neck portion depending from said upper neck portion, said upper neck portion including a proximal end defining a proximal opening, said lower neck portion including a distal end defining a distal opening, said tubular body defining a central bore that passes therethrough, said central bore being concentric about a central axis and passing through said proximal opening and said distal opening; and a flange for coupling with a container, said flange extending radially outward at a junction with said upper neck portion and said lower neck portion, wherein the lower neck portion is configured to extend into the interior of the container and wherein said lower neck portion includes a plurality of vent openings spaced apart from one another about a circumference of the lower neck portion, the vent openings passing through a thickness of the lower neck portion in a generally radial direction from an outside surface of the lower neck portion to an inner surface of the lower neck portion for permitting fluid flow therethrough.

2. The fitment assembly of claim 1, further comprising a circumferential rib that protrudes radially outward from said upper neck portion.

3. The fitment assembly of claim 2, wherein said circumferential rib is disposed at said proximal end of said upper neck portion.

4. The fitment assembly of claim 1, wherein said lower neck portion is configured for coupling with a dip tube.

5. The fitment assembly of claim 1, wherein said interior surface is configured for coupling with a dip tube.

6. The fitment assembly of claim 1, wherein said plurality of vent openings is proximate said flange.

7. The fitment assembly of claim 1, comprising:

a dip tube operatively coupled to said lower neck portion of said fitment, wherein the plurality of vent openings are located between said dip tube and said flange.

8. The fitment assembly of claim 7, wherein said dip tube is operatively coupled to the inner surface of said lower neck portion.

9. The fitment assembly of claim 1, wherein said flange is coupled to a container.

10. The fitment assembly of claim 9, wherein said container is a collapsible, three-dimensional liner.

11. A method for removing head space gas from a liner-based dispenser, comprising:

providing a liner having a fitment assembly coupled thereto, said liner containing a liquid and a headspace gas, said headspace gas being in contact with said fitment assembly, said fitment assembly comprising a fitment for defining a rigid fluid pathway between an interior and an exterior of a container, the fitment including a tubular body having an upper neck portion and a lower neck portion, said lower neck portion depending from said upper neck portion, said upper neck portion including a proximal end defining a proximal opening, said lower neck portion including a distal end defining a distal opening, said tubular body defining a central bore that passes therethrough, said central bore being concentric about a central axis and passing through said proximal opening and said distal opening and a flange for coupling with a container, said flange extending radially outward from said tubular body portion at a junction with said upper neck portion and said lower neck portion, said tubular body defining a central passageway and the lower neck portion is configured to extend into the interior of the container and extends below said flange into said headspace gas contained in said liner, said lower neck portion including a plurality of vent openings spaced apart from one another about a circumference of the lower neck portion, the vent openings passing through a thickness of the lower neck portion in a generally radial direction from an outside surface of the lower neck portion to an inner surface of the lower neck portion for permitting fluid flow therethrough; and providing instructions on a tangible medium, said instructions comprising:

drawing said headspace gas through said vent openings and into said central passageway.

12. The method of claim 11, wherein said instructions further comprise coupling a headspace gas removal connector to said fitment, wherein the step of drawing said headspace gas through said vent openings and into said central passageway is performed with said headspace gas removal connector.

13. A method for removing head space gas from a liner-based dispenser having fitment assembly comprising a fitment for defining a rigid fluid pathway between an interior and an exterior of a container, the fitment including a tubular body having an upper neck portion and a lower neck portion, said lower neck portion depending from said upper neck portion, said upper neck portion including a proximal end defining a proximal opening, said lower neck portion including a distal end defining a distal opening, said tubular body defining a central bore that passes therethrough, said central bore being concentric about a central axis and passing through said proximal opening and said distal opening and a flange for coupling with a container, said flange extending radially outward from said tubular body at a junction with said upper neck portion and said lower neck portion, said flange being mounted to said liner, said lower neck portion extends below said flange, said lower neck portion is configured to extend into the interior of the container and wherein said lower neck portion includes a plurality of vent openings spaced apart from one another about a circumference of the lower neck portion, the vent openings passing through a thickness of the lower neck portion in a generally radial direction from an outside surface of the lower neck portion to an inner surface of the lower neck portion for permitting fluid flow therethrough and are in fluid communication with a central passageway of said tubular body, the method comprising:

depositing a liquid in a liner so that said liner contains said liquid and a headspace gas, the headspace gas being in contact with said vent openings of said lower neck portion of said fitment.

14. The method of claim 13, comprising drawing said headspace gas through said vent openings and into said central passageway.

15. The method of claim 14, comprising coupling a headspace gas removal connector to said fitment, wherein the step of drawing said headspace gas through said vent openings and into said central passageway is performed with said headspace gas removal connector.

* * * * *